US010556435B2

(12) United States Patent
Kunifuji et al.

(10) Patent No.: US 10,556,435 B2
(45) Date of Patent: Feb. 11, 2020

(54) INK JET RECORDING APPARATUS

(71) Applicant: Roland DG Corporation, Hamamatsu-shi, Shizuoka (JP)

(72) Inventors: Tetsuhiro Kunifuji, Hamamatsu (JP); Hironobu Suzuki, Hamamatsu (JP); Akihiro Suzuki, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/310,056

(22) PCT Filed: Jan. 27, 2017

(86) PCT No.: PCT/JP2017/002994
§ 371 (c)(1),
(2) Date: Dec. 14, 2018

(87) PCT Pub. No.: WO2017/217001
PCT Pub. Date: Dec. 21, 2017

(65) Prior Publication Data

US 2019/0329560 A1 Oct. 31, 2019

(30) Foreign Application Priority Data

Jun. 17, 2016 (JP) ..... 2016-120481

(51) Int. Cl.
*B41J 2/175* (2006.01)

(52) U.S. Cl.
CPC ..... *B41J 2/17503* (2013.01)

(58) Field of Classification Search
CPC ... B41J 2/175; B41J 2/01; B41J 2/2107; B41J 2/17553; B41J 2/2114; B41J 2/2117;
(Continued)

(56) References Cited

U.S. PATENT DOCUMENTS 7,014,286 B2 * 3/2006 Yonekubo ..... B41J 2/17553 347/14
9,132,646 B2 * 9/2015 Mitsuo ..... B41J 2/175
2007/0091139 A1 4/2007 Takatsuka

FOREIGN PATENT DOCUMENTS

JP 2002-200764 A 7/2002
JP 2006-188008 A 7/2006
(Continued)

OTHER PUBLICATIONS

Official Communication issued in International Patent Application No. PCT/JP2017/002994, dated Feb. 28, 2017.
(Continued)

*Primary Examiner* — Jannelle M Lebron
(74) *Attorney, Agent, or Firm* — Keating & Bennett, LLP

(57) ABSTRACT

A printer capable includes a pivot mechanism that causes a first ink cartridge housing a first ink pack containing sedimentation ink to pivot. A controller includes a memory storing first data defining a relationship between a determined ink agitation degree and a pivot angle of the ink cartridge from an initial position, an angle determiner that determines a pivot angle based on the determined ink agitation degree and the first data, and a first controller that controls the pivot mechanism to cause the first ink cartridge to pivot by the determined pivot angle and move to a pivot position, and then cause the first ink cartridge to pivot in the opposite direction and return to the initial position. A first pivot angle when the ink agitation degree is less than a first value is smaller than a second pivot angle when the ink agitation degree is the first value or more.

9 Claims, 10 Drawing Sheets

(58) Field of Classification Search
CPC ..... B41J 2/17503; B01F 2215/0059; B01F 11/0002; B01F 11/0017
See application file for complete search history.

(56) References Cited

FOREIGN PATENT DOCUMENTS

| | | | |
|---|---|---|---|
| JP | 2007-098805 | A | 4/2007 |
| JP | 2010-240927 | A | 10/2010 |
| JP | 2015-013375 | A | 1/2015 |
| KR | 10-1347817 | B1 | 1/2014 |

OTHER PUBLICATIONS

Kunifuji et al., "Ink Jet Recording Apparatus," U.S. Appl. No. 16/310,055, filed Dec. 14, 2018.

* cited by examiner

INK JET RECORDING APPARATUS

BACKGROUND OF THE INVENTION

1. Field of the Invention

The present invention relates to an ink jet recording apparatus including a pivot mechanism that causes an ink cartridge to pivot.

2. Description of the Related Art

A known ink jet recording apparatus includes ink heads that discharge ink onto a recording medium. The ink heads have nozzles for discharging ink. The ink discharged from the nozzles includes process color inks such as cyan ink, magenta ink, yellow ink, and black ink, and spot color inks such as white ink and metallic ink. For example, white ink is used for an underlying layer when printing is performed on the recording medium. Metallic ink is used when a special gloss is imparted to the recording medium. These inks are typically contained in ink packs.

Here, particles of a pigment contained in white ink are larger than particles of a pigment in process color ink, and thus, the pigment is easily deposited. Metallic ink contains metal powder and other substances, and the metal powder and other substances are also easily deposited. That is, among the spot color inks, white ink and metallic ink (hereinafter collectively referred to as "sedimentation ink") show gradual sedimentation of a pigment or metal powder and other substances in the sedimentation ink with a lapse of a stationary time. When the pigment or the metal powder and other substances in the sedimentation ink are deposited, the concentration of the sedimentation ink in ink packs varies. Specifically, the concentration of the sedimentation ink is low in an upper-layer portion of the ink packs and is high in a lower-layer portion of the ink packs. When the sedimentation ink in this state is supplied to ink heads, a uniform concentration of the sedimentation ink is not discharged from the ink heads, resulting in a failure in obtaining a desired ink concentration. Accordingly, printing quality might degrade. To solve this problem, Japanese Unexamined Patent Application Publication No. 2002-200764, for example, discloses a technique in which an ink pack containing ink is disposed in a specially designed ink cartridge, and the ink cartridge is caused to pivot. With this technique, the ink in the ink pack is agitated and is dispersed in a preferred manner.

Sedimentation of a pigment and metal powder and other substances contained in sedimentation ink tends to progress with time. In the technique described in Japanese Unexamined Patent Application Publication No. 2002-200764, ink in ink packs is agitated by rotating ink cartridges uniformly, and the degree of sedimentation of the pigment and other substances contained in the ink is not taken into consideration. In a case where sedimentation of the pigment and other substances hardly occurs, the ink cartridges only need to be rotated slightly in order to sufficiently disperse the ink in the ink packs. Nevertheless, in the technique described in Japanese Unexamined Patent Application Publication No. 2002-200764, the ink cartridges need to be rotated greatly and uniformly, which causes the problem of lengthening the time necessary for agitation. Elements for sufficiently agitating the ink include a plurality of technical elements such as a rotation speed, a rotation acceleration, the number of rotations, and the manner of rotation (e.g., whether to rotate in one way or rotate in a reciprocating manner) as well as the rotation angle of the ink cartridges. However, there have been no configurations that effectively combine these technical elements to agitate ink sufficiently in a short time.

SUMMARY OF THE INVENTION

Preferred embodiments of the present invention provide ink jet recording apparatuses capable of reducing the time necessary for agitating sedimentation ink contained in ink packs.

An ink jet recording apparatus according to a preferred embodiment of the present invention includes an ink head including a nozzle that discharges a sedimentation ink onto a recording medium; a pivot mechanism that pivots an ink cartridge housing an ink pack containing a sedimentation ink; and a controller that controls the pivot mechanism, wherein the controller includes a measurer that measures a stationary time of the ink cartridge, an ink agitation degree determiner that determines an ink agitation degree based on at least the stationary time, the ink agitation degree being a degree of ink agitation necessary for the ink cartridge, a memory that stores first data defining a relationship between the ink agitation degree determined by the ink agitation degree determiner and a pivot angle of the ink cartridge from an initial position, an angle determiner that determines the pivot angle based on the ink agitation degree determined by the ink agitation degree determiner and the first data, and a controller that controls the pivot mechanism to perform a first operation of causing the ink cartridge to pivot in a first direction by the determined pivot angle so that the ink cartridge pivots from the initial position to a first pivot position and then perform a second operation of causing the ink cartridge to pivot in a second direction opposite to the first direction so that the ink cartridge returns from the first pivot position to the initial position, a first pivot angle that is the pivot angle when the ink agitation degree is less than a first value is smaller than a second pivot angle that is the pivot angle when the ink agitation degree is the first value or more, and when the ink cartridge pivots from the initial position to the first pivot position, a first end of the ink cartridge is located below a second end of the ink cartridge, and when the ink cartridge pivots from the first pivot position to the initial position, the first end of the ink cartridge is at a level identical to or above the second end.

In an ink jet recording apparatus according to a preferred embodiment of the present invention, the ink agitation degree determiner determines the ink agitation degree to the ink cartridge. The angle determiner determines a pivot angle of the ink cartridge from the initial position based on the determined ink agitation degree and the first data stored in the memory. While the ink pack is in a stationary state, sedimentation of a pigment and metal powder and other substances in the sedimentation ink contained in the ink pack progresses. Depending on the degree of sedimentation and the remaining amount and properties of ink, sedimentation ink in the ink pack is favorably dispersed by agitating the ink pack to a small degree by a small pivot angle in some case, and the sedimentation ink in the ink pack is not favorably dispersed unless the ink in the ink pack is agitated greatly by a large angle. In view of this, the first data stored in the memory defines that the first pivot angle that is the pivot angle when the ink agitation degree is less than the first value is smaller than the second pivot angle that is the pivot angle when the ink agitation degree is the first value or more. The controller causes the ink cartridge to pivot by the relatively small first pivot angle when the ink agitation degree is less than first value showing that sedimentation has not progressed relatively, and causes the ink cartridge to pivot by the relatively large second pivot angle when the ink agitation degree is the first value or more showing that sedimentation has progressed relatively. In this manner, since the pivot angle of the ink cartridge is able to be changed in accordance with the degree of sedimentation of sedimentation ink and the remaining amount and properties of the sedimentation ink, the time necessary for agitating sedimentation ink is able to be reduced, as compared to a case where the ink cartridge is caused to pivot at a uniform pivot angle. The controller is configured or programmed such that when ink cartridge pivots from the initial position to the first pivot position, the first end of the ink cartridge is located below the second end of the ink cartridge, and when the ink cartridge pivots from the first pivot position to the initial position, the first end of the ink cartridge is located at a level identical to or above the second end of the ink cartridge. Accordingly, sedimentation ink in the ink pack is able to be favorably agitated.

According to preferred embodiments of the present invention, ink jet recording apparatuses capable of reducing the time for agitating sedimentation ink contained in ink packs are provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
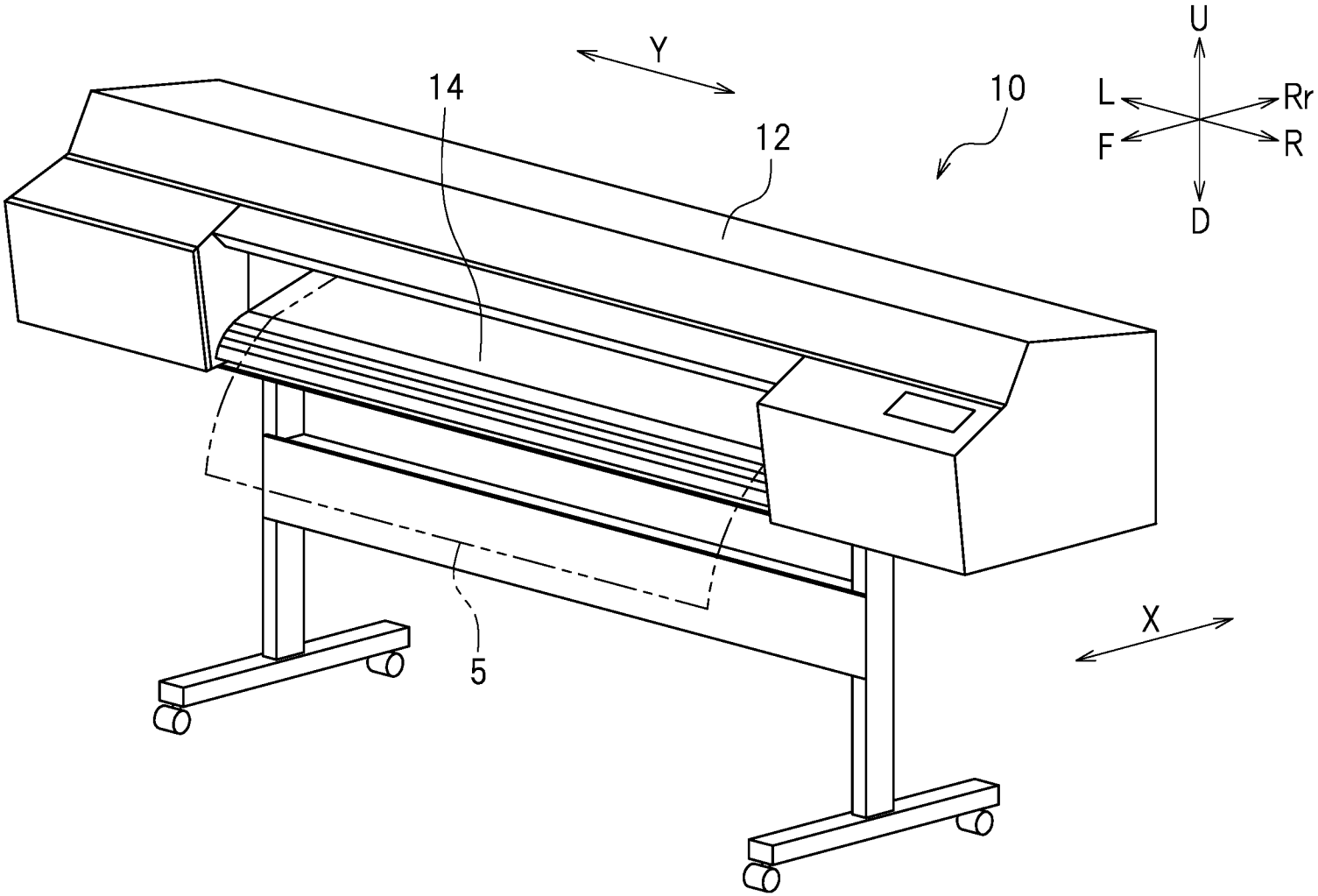
FIG. 1 is a perspective view of an ink jet printer according to a preferred embodiment of the present invention.

An ink jet recording apparatus according to a first preferred embodiment will be described with reference to the drawings. The ink jet recording apparatus according to the first preferred embodiment is an ink jet printer (hereinafter referred to as a printer) 10 that performs printing on a recording medium. The preferred embodiments described here are, of course, not intended to particularly limit the present invention. Elements and features having the same functions are denoted by the same reference numerals, and description for the same elements and portions will not be repeated or will be simplified as appropriate.

Figure 2:
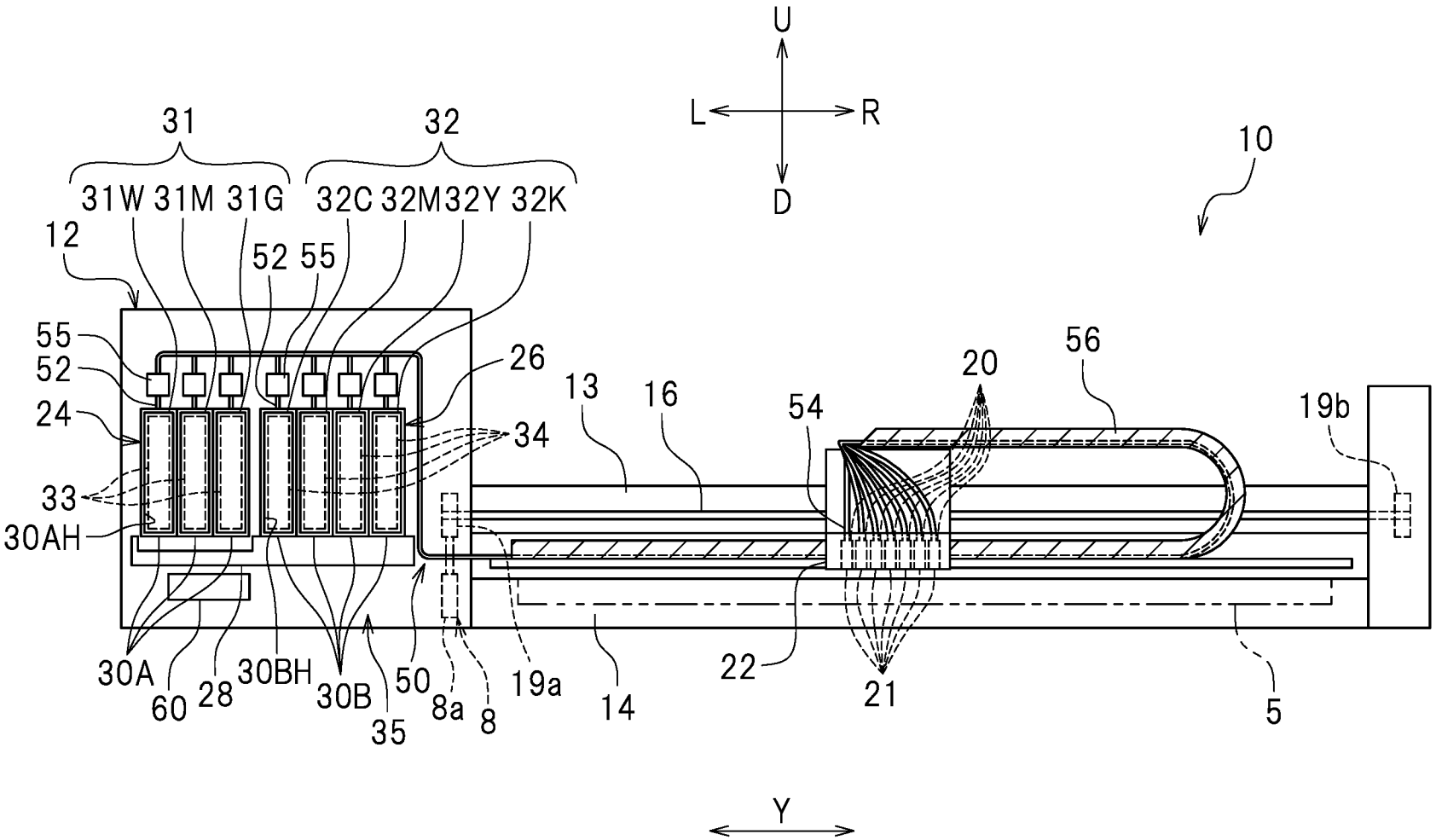
FIG. 2 is a front view of a main portion of an ink jet printer according to a preferred embodiment of the present invention.

FIG. 1 is a perspective view of the printer 10 according to the first preferred embodiment. FIG. 2 is a front view of a main portion of the printer 10 according to the first preferred embodiment. The printer 10 performs printing on a recording medium 5. The recording medium 5 includes not only papers such as plain paper but also media made of a variety of materials including resin materials such as polyvinyl chloride (PVC), polyester resin, aluminum, iron, wood, and so forth.

In the following description, left, right, up, and down respectively refer to left, right, up, and down seen from an operator at the front of the printer 10. The direction toward the operator from the printer 10 will be hereinafter referred to as forward, and the opposite direction away from the operator will be hereinafter referred to as rearward. Characters F, Rr, L, R, U, and D in the drawings represent front, rear, left, right, up, and down, respectively. Ink heads 20 (see FIG. 2) are movable leftward and rightward. The recording medium 5 can be conveyed forward and rearward. In this preferred embodiment, the direction of movement of the ink heads 20 will be referred to as a main scanning direction Y, and the direction of conveyance of the recording medium 5 will be referred to as a sub-scanning direction X. Here, the main scanning direction Y corresponds to the left-right direction, and the sub-scanning direction X corresponds to the front-rear direction. The main scanning direction Y and the sub-scanning direction X are orthogonal to each other. It should be noted that these directions are defined simply for convenience of description, and do not limit the state of installation of the printer 10.

As illustrated in FIG. 1, the printer 10 includes a body 12 and a platen 14 disposed on the body 12. The recording medium 5 is placed on the platen 14.

As illustrated in FIG. 2, the printer 10 includes a guide rail 13 provided on the body 12. The guide rail 13 extends in the left-right direction. A carriage 22 is engaged with the guide rail 13. The carriage 22 reciprocates along the guide rail 13 in the left-right direction (the main scanning direction Y) by a carriage movement mechanism 8. The carriage movement mechanism 8 includes a pulley 19*a* disposed at the left end of the guide rail 13 and a pulley 19*b* disposed at the right end of the guide rail 13. A carriage motor 8*a* is coupled to the pulley 19*a*. The carriage motor 8*a* may be coupled to the pulley 19*b*. The pulley 19*a* is driven by the carriage motor 8*a*. An endless belt 16 is wound around each of the pulley 19*a* and the pulley 19*b*. The carriage 22 is fixed to the belts 16. When the pulley 19*a* and the pulley 19*b* rotate to cause the belts 16 to travel, the carriage 22 moves in the left-right direction. In this manner, the carriage 22 is movable in the left-right direction along the guide rail 13.

The platen 14 is provided with a pair of upper and lower grid rollers (not shown) and pinching rollers (not shown). The grid rollers are coupled to a feed motor (not shown). The grid rollers are rotatably driven by the feed motor. When the grid rollers rotate with the recording medium 5 sandwiched between the grid rollers and the pinching rollers, the recording medium 5 is conveyed forward or rearward (sub-scanning direction X).

As illustrated in FIG. 2, the printer 10 includes a plurality of first ink cartridges 31 and a plurality of second ink cartridges 32. The first ink cartridges 31 and the second ink cartridges 32 are tanks that store ink. The first ink cartridges 31 have the same configuration as that of the second ink cartridges 32. That is, the second ink cartridges 32 housing second ink packs 34 described later and charged with process color ink can be used as the first ink cartridges 31 housing first ink packs 33 described later and charged with spot color ink. Each of the first ink cartridges 31 and the second ink cartridges 32 has a rectangular parallelepiped shape.

As illustrated in FIG. 2, the first ink cartridges 31 house the first ink packs 33 charged with spot color ink. The plurality of first ink cartridges 31W, 31M, and 31G are detachably attached to a first container 24 (see also FIG. 3). The plurality of first ink cartridges 31W, 31M, and 31G are detachably connected to first ends 52 of ink paths 50 described later. The ink cartridge 31W houses the first ink pack 33 charged with white ink. The ink cartridge 31M houses the first ink pack 33 charged with metallic ink. The ink cartridge 31G houses the first ink pack 33 charged with gloss ink. The white ink and the metallic ink are sedimentation inks showing sedimentation of ink components (pigment particles, metal powder, and other substances) with a lapse of a rest time. The gloss ink is a non-sedimentation ink that does not show sedimentation of an ink component independently of a lapse of the rest time. The inks contained the first ink packs 33 are not limited to the examples described above.

As illustrated in FIG. 2, the second ink cartridges 32 house the second ink packs 34 charged with process color inks. The plurality of second ink cartridges 32C, 32M, 32Y, and 32K are detachably attached to a second container 26 described later (see also FIG. 3). The plurality of second ink cartridges 32C, 32M, 32Y, and 32K are detachably connected to the first ends 52 of the ink paths 50. The ink cartridge 32C houses the second ink pack 34 charged with cyan ink. The ink cartridge 32M contains the second ink pack 34 charged with magenta ink. The ink cartridge 32Y contains the second ink pack 34 charged with yellow ink. The ink cartridge 32K contains the second ink pack 34 charged with black ink. The inks contained in the second ink packs 34 are not limited to the examples described above. The second ink packs 34 may be charged with inks such as light yellow ink, light magenta ink, and light cyan ink. The process color inks in this preferred embodiment are non-sedimentation inks that do not show sedimentation of ink components independently of a lapse of the rest time.

Figure 4:
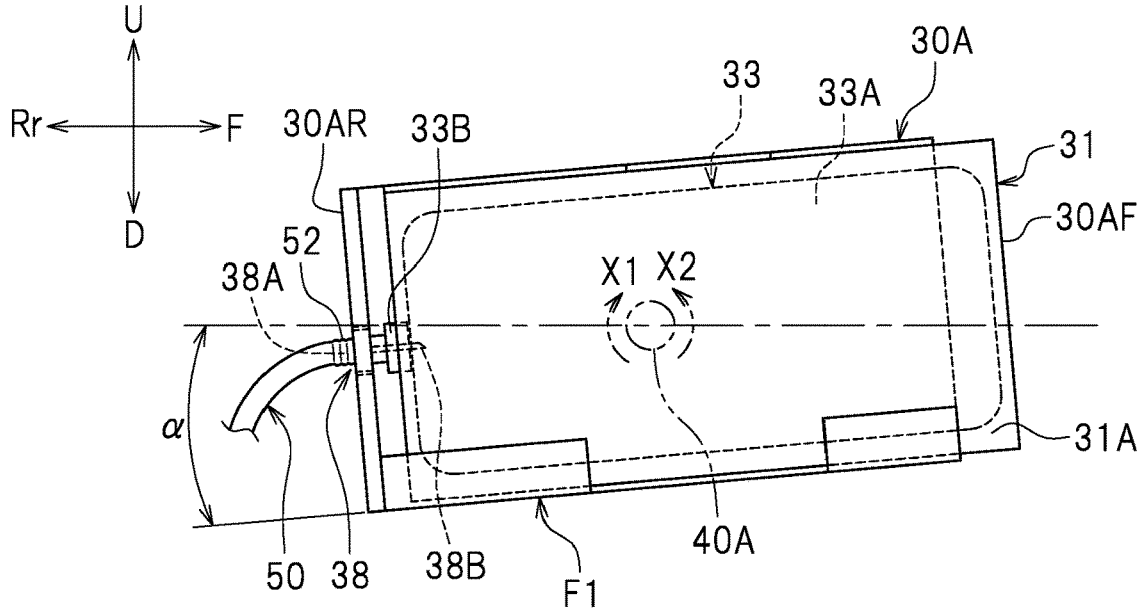
FIG. 4 is an explanatory view illustrating a state where ink cartridges are housed in cartridge holders according to a preferred embodiment of the present invention.

As illustrated in FIG. 4, each of the first ink packs 33 includes a body 33A containing spot color ink and a supply port 33B from which the spot color ink in the body 33A is supplied to the corresponding ink path 50 described later. The second ink packs 34 have a structure similar to that of the first ink packs except that inks contained in the second ink packs 34 are process color inks, and thus, description thereof will not be repeated.

As illustrated in FIG. 2, the printer 10 includes an ink supply system 35 for each of the first ink cartridges 31 and the second ink cartridges 32 individually containing inks of different colors. The ink supply systems 35 include the ink heads 20, dampers (not shown), the ink paths 50, and supply pumps 55, in addition to the first ink cartridges 31 and the second ink cartridges 32. The ink heads 20 and the dampers (not shown) are mounted on the carriage 22 and reciprocate in the left-right direction. On the other hand, the first ink cartridges 31 and the second ink cartridges 32 are not mounted on the carriage 22 and do not reciprocate in the left-right direction. Thus, to prevent damage of the ink paths 50 even with movement of the carriage 22 in the left-right direction, a large portion (at least a half of the total length) of the ink paths 50 is arranged to extend in the left-right direction. In this preferred embodiment, since seven types of inks are used, seven ink paths 50 are provided in total, for example. The ink paths 50 are covered with cable protection and guide devices 56. The cable protection and guide devices 56 are, for example, cableveyors (registered trademark).

As illustrated in FIG. 2, the ink heads 20 include a plurality of nozzles 21 each of which discharges a spot color ink or a process color ink onto the recording medium 5. That is, each of the nozzles 21 discharges a sedimentation ink or a non-sedimentation ink. The dampers (not shown) communicate with the ink heads 20 and supply the ink heads 20 with the spot color inks or the process color inks. The dampers also reduce a pressure variation of the inks. The dampers stabilize an ink discharge operation of the ink heads 20.

Figure 3:
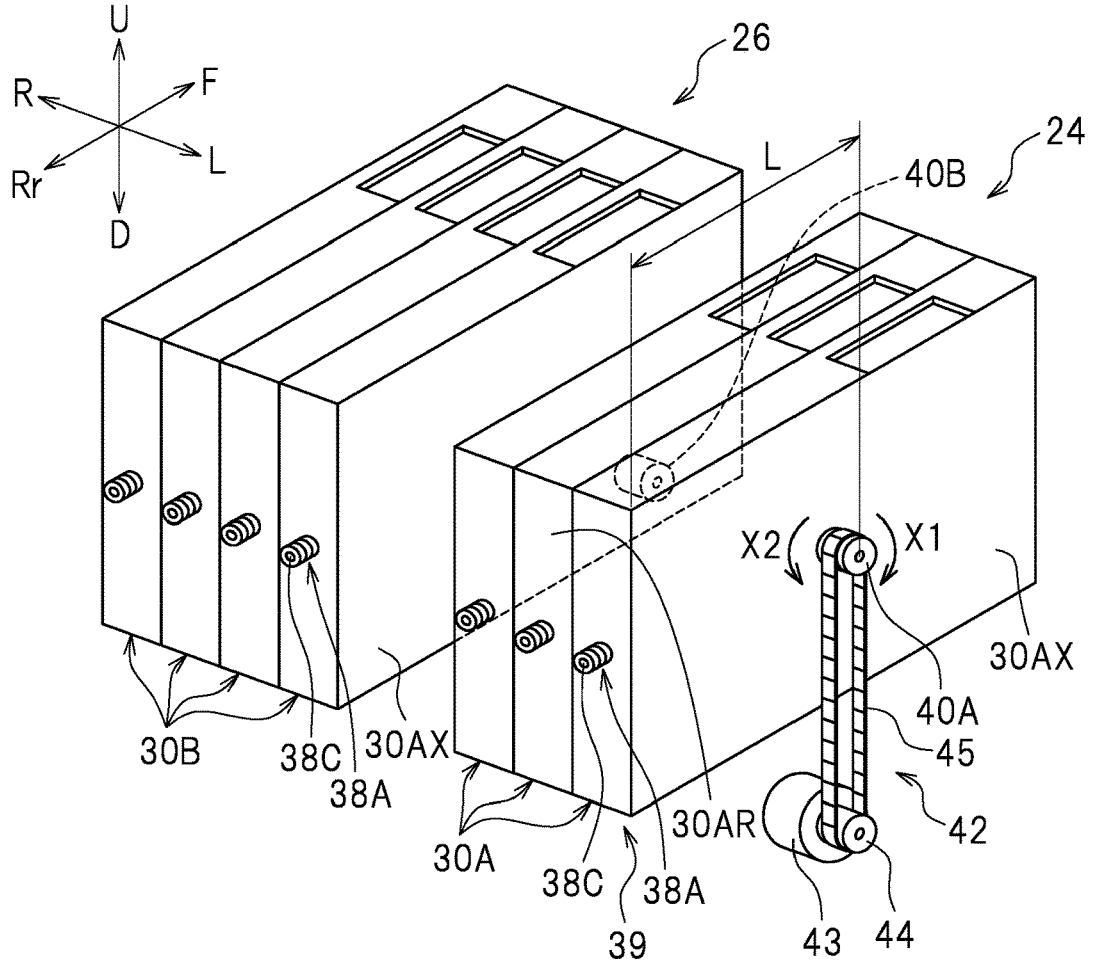
FIG. 3 is a perspective view of cartridge holders according to a preferred embodiment of the present invention.

As illustrated in FIG. 2, the first ink cartridges 31 and the second ink cartridges 32 communicate with the ink heads 20 through the ink paths 50. The first ends 52 of the ink paths 50 are detachably connected to projections 38A (see FIG. 5) of connection members 38 described later of the first ink cartridges 31 and the second ink cartridges 32. The second ends 54 of the ink paths 50 are connected to the dampers (not shown). The second ends 54 of the ink paths 50 communicate with the ink heads 20. The ink paths 50 define channels that guide inks from the first ink cartridges 31 and the second ink cartridges 32 to the ink heads 20. The ink paths 50 are soft and flexible, and are elastically deformable. The ink paths 50 are not limited to a specific structure, and are resin tubes that are easily deformable in this preferred embodiment. The ink paths 50 may be made of a material except tubes. A portion of the ink paths 50 may be defined by tubes. Here, as illustrated in FIG. 3, suppose the minimum distance from a first shaft 40A described later to rear ends 30AR of first cartridge holders 30A is L, the ink paths 50 connected to the first ink cartridges 31 preferably have a backlash length larger than about 1.4 L.

As illustrated in FIG. 2, the supply pumps 55 are disposed on the ink paths 50. The supply pumps 55 are capable of supplying (sending) inks from the first ink cartridges 31 and the second ink cartridges 32 toward the ink heads 20. The supply pumps 55 of this preferred embodiment are tube pumps, but are not limited the tube pumps.

As illustrated in FIG. 2, the printer 10 includes the first container 24, the second container 26, and a frame member 28. The first container 24, the second container 26, and the frame member 28 are provided in the body 12. The first container 24 includes the plurality of first cartridge holders 30A. The first cartridge holders 30A are pivotably supported by the frame member 28. The state where the first cartridge holders 30A are pivotably supported by the frame member 28 includes a state where the first cartridge holders 30A are pivotably supported indirectly by the frame member 28 through another member provided on the frame member 28. The plurality of first cartridge holders 30A are fixed to one another. The first cartridge holders 30A house the first ink cartridges 31 inserted through first insertion ports 30AH described later. The second container 26 includes a plurality of second cartridge holders 30B. The second cartridge holders 30B are non-pivotably supported by the frame member 28. The plurality of second cartridge holders 30B are fixed to one another. The second cartridge holders 30B house the second ink cartridges 32 inserted through second insertion ports 30BH described later. The frame member 28 extends in the main scanning direction Y. As illustrated in FIG. 3, the first cartridge holders 30A are disposed at a side of the second cartridge holders 30B. In this preferred embodiment, the first cartridge holders 30A are disposed at the left of the second cartridge holders 30B but may be disposed at the right of the second cartridge holders 30B.

The configuration of the second cartridge holders 30B is the same as that of the first cartridge holders 30A, and thus, description will be given only on the first cartridge holders 30A. Specifically, the first insertion ports 30AH and the second insertion ports 30BH are different in that the first ink cartridges 31 housing the first ink packs 33 changed with spot color inks are inserted through the first insertion ports 30AH whereas the second ink cartridges 32 housing the second ink packs 34 charged with process color inks are inserted through the second insertion ports 30BH, but are the same in structure. As illustrated in FIG. 4, each of the first cartridge holders 30A houses the corresponding first ink cartridge 31 in a vertically oriented state.

Specifically, the first ink cartridge 31 is disposed such that a wide surface 31A having the largest area in the first ink cartridge is oriented vertically or substantially vertically to the horizontal plane. In this preferred embodiment, the first cartridge holder 30A tilts upward toward the front in an initial position F1. Specifically, the front end 30AF of the first cartridge holder 30A is located above the rear end 30AR of the first cartridge holder 30A in the initial position F1. A tilt angle $\alpha$ of the first cartridge holder 30A with respect to the horizontal direction in the initial position F1 is about 5°, for example. Accordingly, the first ink cartridge 31 housed in the first cartridge holder 30A is disposed while tilting upward toward the front.

Figure 5:
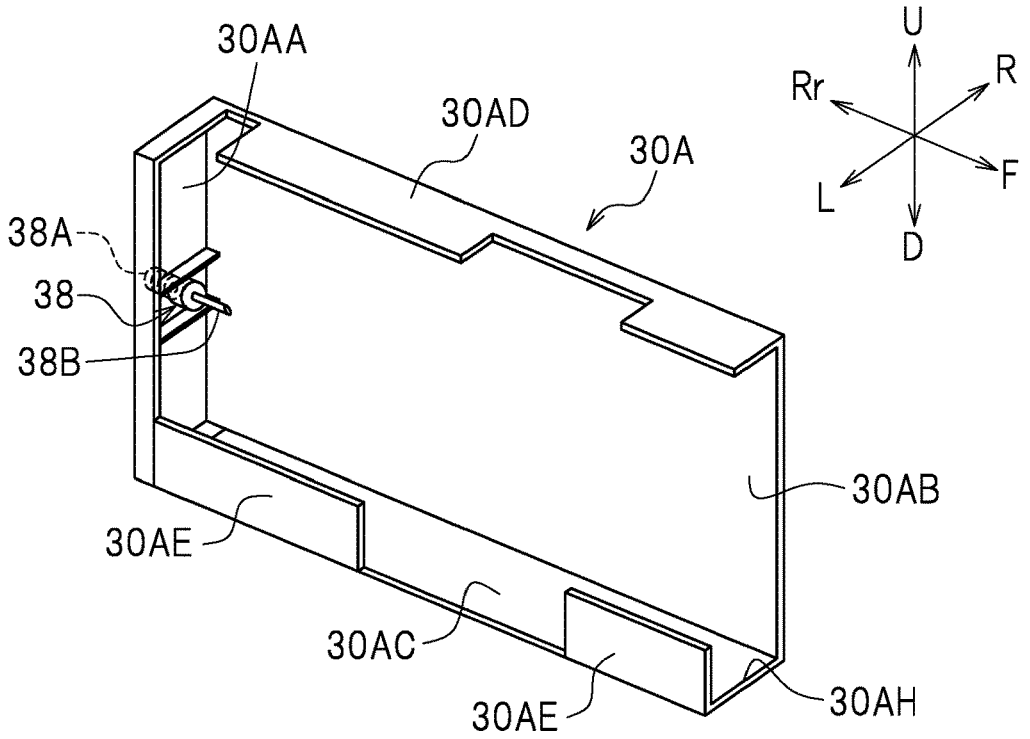
FIG. 5 is a perspective view of cartridge holders according to a preferred embodiment of the present invention.

As illustrated in FIG. 5, each of the first cartridge holders 30A includes a rear wall 30AA, a right wall 30AB extending forward from the right end of the rear wall 30AA, a lower wall 30AC extending forward from the lower end of the rear wall 30AA, an upper wall 30AD extending leftward from the upper end of the right wall 30AB, and a left wall 30AE extending upward from the left end of the lower wall 30AC. The right wall 30AB, the lower wall 30AC, the upper wall 30AD, and the left wall 30AE define the first insertion port 30AH through which the corresponding first ink cartridge 31 is inserted from the front to the rear. The first insertion port 30AH is open horizontally. In this preferred embodiment, the phrase "open horizontally" includes a state where the opening is oriented in a direction tilted with respect to the horizontal plane within the range from 0° to about 30°, inclusive, in the front-rear direction and/or the left-right direction. The first insertion port 30AH is open forward. The first ink cartridge 31 is inserted through the first insertion port 30AH.

As illustrated in FIG. 5, each of the first cartridge holders 30A includes the connection member 38. The connection member 38 is provided on the rear wall 30AA of the first cartridge holders 30A. The connection member 38 includes the projection 38A to which the first end 52 of the corresponding ink path 50 (see FIG. 2) is connected, and a needle member 38B connected to the supply port 33B of the first ink pack 33 (see FIG. 4). The projection 38A is an example of a first portion of the connection member 38. The needle member 38B is an example of a second portion of the connection member 38. The projection 38A extends rearward from the rear wall 30AA. The projection 38A includes an outlet 38C communicating with the needle member 38B (see FIG. 3). The needle member 38B extends forward from the rear wall 30AA and has a channel therein. The needle member 38B pierces the supply port 33B of the first ink pack 33 housed in the first ink cartridge 31, and the spot color ink in the first ink pack 33 is supplied to the ink path 50 through the connection member 38 (i.e., the needle member 38B and the outlet 38C).

As illustrated in FIG. 3, a plate member 30AX is provided to the leftmost first cartridge holder 30A in the plurality of first cartridge holders 30A. The plate member 30AX has substantially the same shape as that of the right walls 30AB of the first cartridge holders 30A (see FIG. 5).

As illustrated in FIG. 3, the first container 24 is provided with a pivot mechanism 39. The pivot mechanism 39 causes the first ink cartridges 31 (see FIG. 2) housing the first ink packs 33 (see FIG. 2) charged with the sedimentation inks to pivot. The pivot mechanism 39 includes a pair of first shafts 40A and 40B pivotably supporting the first cartridge holders 30A and a first driving mechanism 42 that causes the first cartridge holders 30A about the first shafts 40A and 40B to pivot. The first driving mechanism 42 includes a first motor 43, a first spindle 44 provided to the first motor 43, and an endless belt 45 wound around the first spindle 44 and the first shaft 40A. The first motor 43 is attached to the frame member 28 (see FIG. 2). The first shaft 40A is provided to the plate member 30AX disposed on the leftmost first cartridge holders 30A in the plurality of first cartridge holders 30A. The first shaft 40B is provided to the right wall 30AB of the rightmost first cartridge holders 30A in the plurality of first cartridge holders 30A (see FIG. 5). The first spindle 44 and the first shafts 40A and 40B extend horizontally in a direction orthogonal to the direction in which the first ink cartridges 31 are inserted (front-rear direction in this preferred embodiment). In this preferred embodiment, the first spindle 44 and the first shafts 40A and 40B extend in the left-right direction. The axis of the first shaft 40A coincides with the axis of the first shaft 40B. The first shafts 40A and 40B are attached to a bearing provided on the frame member 28 and pivotably supporting the first shafts 40A and 40B. When the first motor 43 is driven to cause the belt 45 to travel, the first cartridge holders 30A pivot about the first shafts 40A and 40B in the front-rear direction (indicated by arrows X1 and X2 in FIG. 3).

As illustrated in FIG. 2, the printer 10 includes a controller 60. The entire operation of the printer 10 is controlled by the controller 60. The controller 60 is, for example, a computer, and may include a central processing unit (hereinafter referred to as a CPU), a ROM storing programs to be executed by the CPU, a RAM, and so forth. The controller 60 is operatively connected (wired or wirelessly) to the carriage motor 8*a*, the ink heads 20, the first motor 43, and the supply pumps 55. The controller 60 controls operation and stopping of the carriage motor 8*a*. The controller 60 controls discharge of inks from the nozzles 21 of the ink heads 20. The controller 60 controls operation and stopping of the supply pumps 55. The controller 60 controls operation and stopping of the first motor 43.

Figure 6:
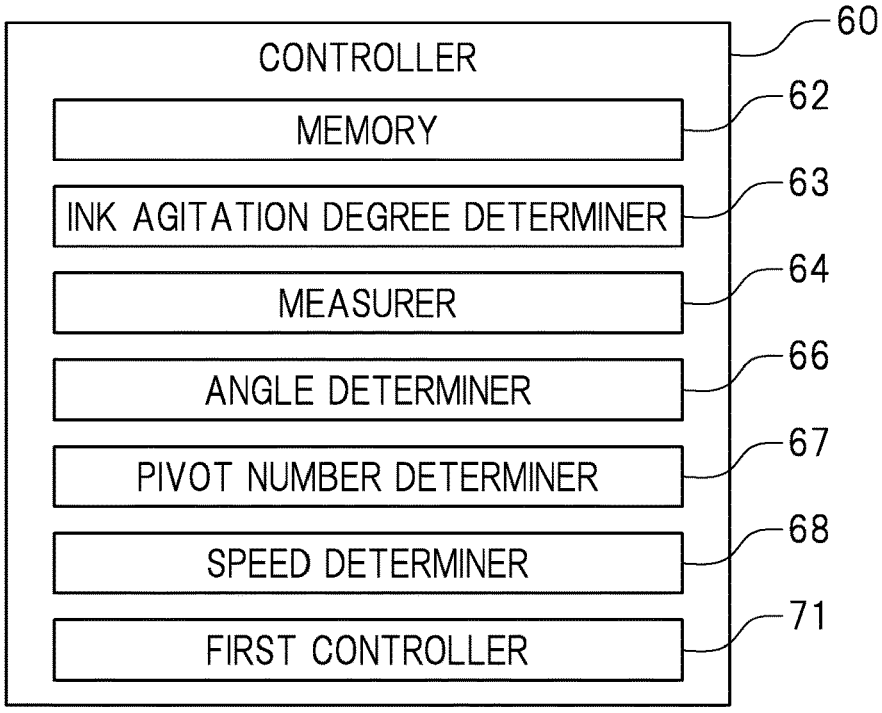
FIG. 6 is a block diagram of a controller according to a preferred embodiment of the present invention.

As illustrated in FIG. 6, the controller 60 is configured or programmed to include a memory 62, an ink agitation degree determiner 63, a measurer 64, an angle determiner 66, a pivot number determiner 67, a speed determiner 68, and a first controller 71.

Figure 7:
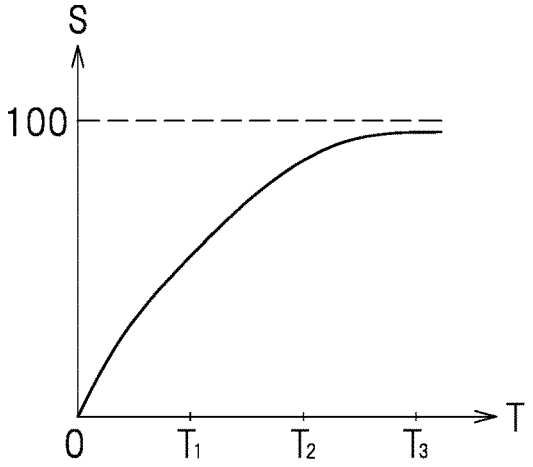
FIG. 7 is a graph showing a relationship between a sedimentation degree of sedimentation ink and a rest time of the ink cartridges.

The memory 62 stores sedimentation data that defines a relationship between a rest time (e.g., rest time of the first ink packs 33) T of the first ink cartridges 31 housing sedimentation inks and a proportion S of sedimentation of the sedimentation inks contained in the first ink packs 33 (typically sedimentation of a pigment and metal powder and other substances included in the sedimentation ink) (hereinafter a proportion S of the sedimentation inks contained in the first ink packs 33 will be referred to as an ink sedimentation degree S). FIG. 7 is a graph showing a relationship between the ink sedimentation degree S and the rest time T of the first ink cartridges 31, and shows an example of sedimentation data stored in the memory 62. In FIG. 7, the ordinate represents an ink sedimentation degree S[%], and the abscissa represents a rest time[hour]. The rest time T refers to a time in which the first ink cartridges 31 (i.e., the first ink packs 33) do not pivot.

The memory 62 stores information concerning various properties of sedimentation inks, such as cohesiveness of a pigment and metal powder and other substances, specific gravity, viscosity, temperature properties, (hereinafter referred to as ink component information).

The measurer 64 measures a rest time T of the first cartridge holders 30A (i.e., the first ink cartridges 31). The measurer 64 measures a time from when the first ink cartridges 31 finish pivoting to when the first ink cartridges 31 start pivoting next.

The ink agitation degree determiner 63 determines an ink agitation degree SS that is an ink agitation degree necessary for the first ink cartridges 31. The ink agitation degree determiner 63 obtains information on the ink sedimentation degree S from the sedimentation data (see FIG. 7) stored in the memory 62 based on the rest time T of the first ink cartridges 31 measured by the measurer 64. The ink agitation degree determiner 63 obtains an ink agitation degree SS indicating the degree of ink agitation performed by the printer 10, from the sedimentation data as a basis of information of the ink sedimentation degree S stored in the memory 62, the amount of remaining sedimentation ink in the first ink packs 33, the ink component information, the ink temperature, specification of the agitation degree by an operator, and so forth. The degree of cancellation of the ink sedimentation degree S by ink agitation operation can differ depending on the difference in the amount of remaining sedimentation ink in the first ink packs 33 in some cases. In the case of a shape as that of the first ink packs in the rectangular-parallelepiped first ink cartridges 31 described in this preferred embodiment (see FIG. 4), some types of sedimentation ink show a tendency in which the ink agitation amount (the integrated quantity of the pivot angle and the speed) to the remaining ink amount, which is necessary for agitating deposited sedimentation to a degree at which no significant problem occurs in printing quality, increases as the amount of remaining ink decreases. The specification of the agitation degree by an operator includes intentional specification of a necessary degree of ink agitation in order to secure a safe factor of printing quality, for example, in a case where an operator who performs printing with the printer 10 intends to agitate ink sufficiently more than a degree a specified by the printer 10.

Figure 8:
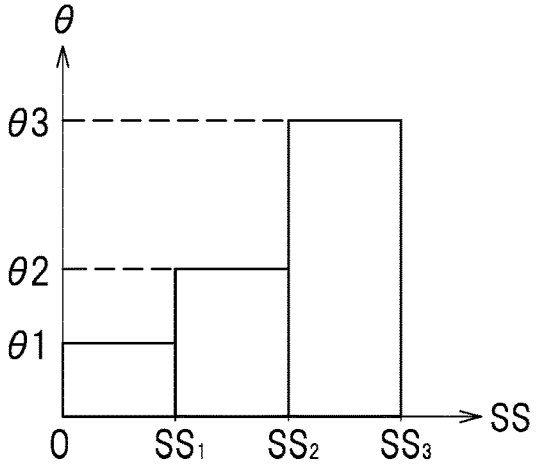
FIG. 8 is a graph showing a relationship between a pivot angle of ink cartridges and an ink agitation degree of the ink cartridges.

The memory 62 stores first data that defines a relationship between the ink agitation degree SS of the first ink cartridges 31 and the pivot angle θ of the first ink cartridges 31 from the initial position F1. The first data is created beforehand based on the sedimentation data, the amount of remaining ink, the ink component information, the ink temperature, the specification of the agitation degree by the operator, and so forth. In the first data, a first pivot angle θ1 that is a pivot angle θ when the ink agitation degree SS is less than a first value $SS_1$ is smaller than a second pivot angle θ2 that is a pivot angle θ when the ink agitation degree SS is the first value $SS_1$ or more. FIG. 8 is a graph showing a relationship between the pivot angle θ of the first ink cartridges 31 and the ink agitation degree SS of the first ink cartridges, and shows an example of the first data stored in the memory 62. In FIG. 8, the ordinate represents the pivot angle θ[°], and the abscissa represents the ink agitation degree SS. In the example shown in FIG. 8, when the ink agitation degree is 0 (zero) or more and less than $SS_1$, the pivot angle θ is the first pivot angle θ1 (e.g., $0° < \theta 1 < 90°$, preferably $30° \leq \theta 1 < 90°$, when the ink agitation degree is $SS_1$ or more and less than $SS_2$, the pivot angle θ is the second pivot angle θ2 (e.g., $90° \leq \theta 2 < 180°$), and when the ink agitation degree is $SS_2$ or more and less than SS3, the pivot angle θ is a third pivot angle θ3 (e.g., $180° \leq \theta 3 < 270°$). The relationship between the pivot angle θ and the ink agitation degree SS is not limited to the example described above.

Figure 9:
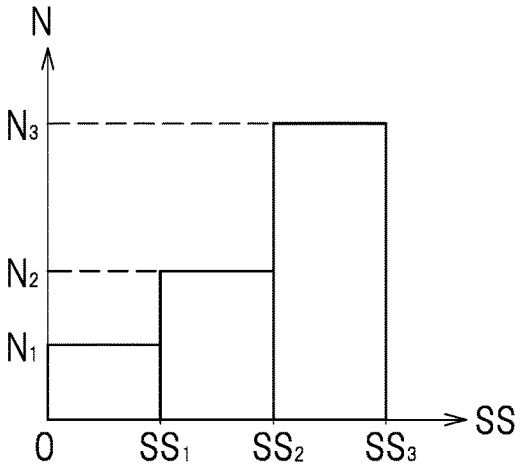
FIG. 9 is a graph showing a relationship between the number of pivots of ink cartridges and an ink agitation degree of the ink cartridges.

The memory 62 stores second data that defines a relationship between the ink agitation degree SS of the first ink cartridges 31 and the pivot number N of the first ink cartridges 31. The second data is created beforehand based on the sedimentation data, the amount of remaining ink, the ink component information, the ink temperature, the specification of the agitation degree by the operator, and so forth. In the second data, a first pivot number $N_1$ that is a pivot number N when the ink agitation degree SS is less than the first value $SS_1$ is smaller than a second pivot number $N_2$ that is a pivot number N when the ink agitation degree SS is the first value $SS_1$ or more. FIG. 9 is a graph showing a relationship between the pivot number N of the first ink cartridges 31 and the ink agitation degree SS of the first ink cartridges, and shows an example of the second data stored in the memory 62. In FIG. 9, the ordinate represents the pivot number N, and the abscissa represents the ink agitation degree SS. In the example shown in FIG. 9, the pivot number N is a first pivot number $N_1$ when the ink agitation degree is 0 (zero) or more and less than $SS_1$, the pivot number N is a second pivot number $N_2$ ($N_2 > N_1$) when the ink agitation degree is $SS_1$ or more and less than $SS_2$, and the pivot number N is a third pivot number $N_3$ ($N_3 > N_2$) when the ink agitation degree is $SS_2$ or more and less than SS3. The relationship between the pivot number N and the ink agitation degree SS is not limited to the example described above.

Figure 10:
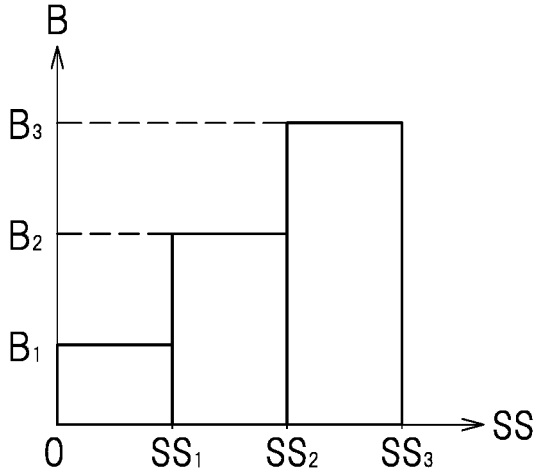
FIG. 10 is a graph showing a relationship between a pivot speed of ink cartridges and an ink agitation degree of the ink cartridges.

The memory 62 stores third data that defines a relationship between the ink agitation degree SS of the first ink cartridges 31 and the pivot speed B of the first ink cartridges 31. The third data is created beforehand based on the sedimentation data, the amount of remaining ink, the ink component information, the ink temperature, the specification of the agitation degree by the operator, and so forth. In the third data, a first pivot speed B1 that is a pivot speed B when the ink agitation degree SS is less than the first value $SS_1$ is smaller than a second pivot speed B2 that is a pivot speed B when the ink agitation degree SS is the first value $SS_1$ or more. FIG. 10 is a graph showing a relationship between the pivot speed B of the first ink cartridges 31 and the ink agitation degree SS of the first ink cartridges 31, and shows an example of the third data stored in the memory 62. In FIG. 10, the ordinate represents the pivot speed B [km/h], and the abscissa represents the ink agitation degree SS. In the example shown in FIG. 10, the pivot speed B is the first pivot speed B1 when the ink agitation degree is 0 (zero) or more and less than $SS_1$, the pivot speed B is the second pivot speed B2 (B2>B1) when the ink agitation degree is $SS_1$ or more and less than $SS_2$, and the pivot speed B is the third pivot speed B3 (B3>B2) when the ink agitation degree is $SS_2$ or more and less than SS3. The relationship between the pivot speed B and the ink agitation degree SS is not limited to the example described above.

The angle determiner 66 determines the pivot angle θ based on the ink agitation degree SS determined by the ink agitation degree determiner 63 and the first data. For example, if the ink agitation degree SS is larger than $SS_1$ and smaller than $SS_2$, the pivot angle θ is determined to be θ2 in the example shown in FIG. 8.

The pivot number determiner 67 determines the pivot number N based on the ink agitation degree SS determined by the ink agitation degree determiner 63 and the second data. For example, if the ink agitation degree SS is larger than $SS_1$ and smaller than $SS_2$, the pivot number N is determined to be $N_2$ in the example shown in FIG. 9.

The speed determiner 68 determines the pivot speed B based on the ink agitation degree SS determined by the ink agitation degree determiner 63 and the third data. For example, if the ink agitation degree SS is larger than $SS_1$ and less than $SS_2$, the pivot speed B is determined to be B2 in the example shown in FIG. 10.

Figure 11:
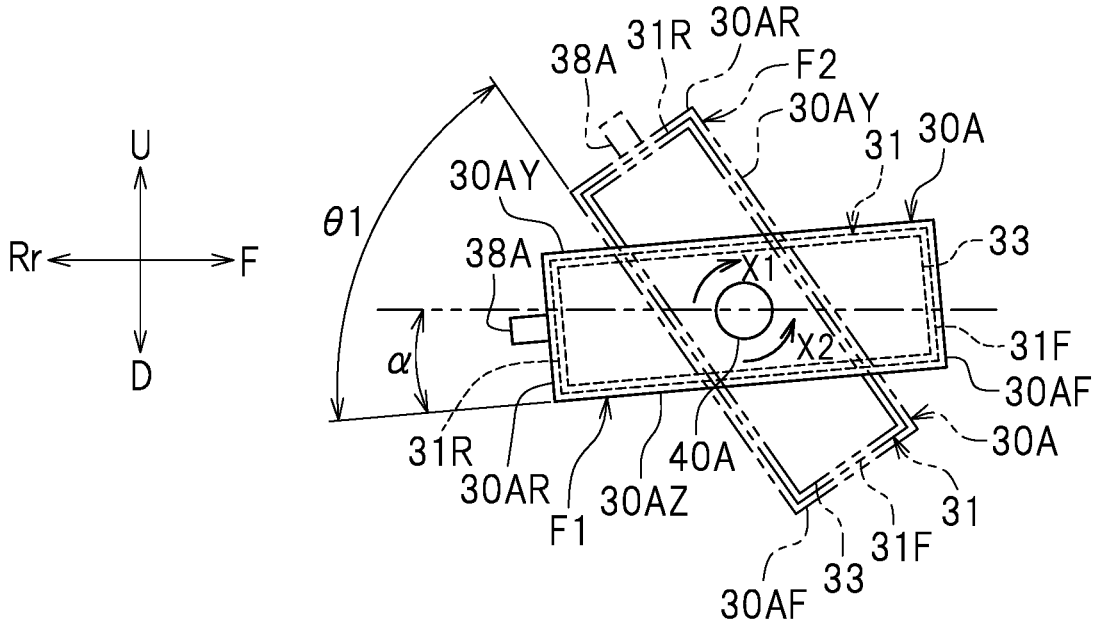
FIG. 11 is an explanatory view illustrating a state where ink cartridges pivot by a pivot angle θ1 from an initial position.

The first controller 71 controls the first motor 43 of the first driving mechanism 42 to cause the first cartridge holders 30A (i.e., the first ink cartridges 31) and agitate sedimentation ink contained in the first ink packs 33. The first controller 71 may control the first motor 43 of the first driving mechanism 42 to perform a first operation of causing the first cartridge holders 30A (i.e., the first ink cartridges 31) to pivot by the determined pivot angle θ in a first direction (direction indicated by arrow X1 in FIG. 3) so that the first cartridge holders 30A pivot from the initial position F1 to a first pivot position, and then perform a second operation of causing the first cartridge holders 30A to pivot in a second direction (direction indicated by arrow X2 in FIG. 3) opposite to the first direction so that the first cartridge holders 30A return from the first pivot position to the initial position F1. Here, as illustrated in FIG. 11, when the first cartridge holders 30A (i.e., the first ink cartridges 31) pivot from the initial position F1 to a first pivot position F2, first ends (front ends 30AF in this preferred embodiment) of the first cartridge holders 30A are located below second ends (rear ends 30AR in this preferred embodiment) of the first cartridge holders 30A, whereas when the first cartridge holders 30A pivot from the first pivot position F2 to the initial position F1, the first ends (front ends 30AF) of the first cartridge holders 30A are located above the second ends (rear ends 30AR) of the first cartridge holders 30A. When the printer 10 is turned on, the first controller 71 may cause the first cartridge holders 30A (i.e., the first ink cartridges 31) to pivot by the pivot angle θ2 or the pivot angle θ3. Preferably, when the printer 10 is turned on, the first controller 71 causes the first cartridge holders 30A (i.e., the first ink cartridges 31) to pivot by a maximum pivot angle. The timing of causing the first ink cartridges 31 to pivot can be set at any timing. The first controller 71 causes the first cartridge holders 30A to pivot a pivot number of times N determined by the pivot number determiner 67. The first controller 71 preferably repeatedly performs an operation of causing the first cartridge holders 30A to pivot a predetermined pivot number N of times determined by the pivot number determiner 67 at a predetermined time interval I (e.g., about one hour to ten hours, preferably about two hours to four hours). The first controller 71 may perform a periodic head maintenance operation of sucking ink from the nozzles 21 of the ink heads 20 in each predetermined printing stop time. In this case, before the periodic head maintenance is performed, the first controller 71 may perform an operation of causing the first cartridge holders 30A (i.e., the first ink cartridges 31) to pivot a pivot number of times N determined by the pivot number determiner 67. The first controller causes the first cartridge holders 30A to pivot at a pivot speed B determined by the speed determiner 68.

FIG. 11 is an explanatory view illustrating a state where the first cartridge holders 30A (i.e., the first ink cartridges 31) pivots from the initial position F1 to the first pivot position F2. In the initial position F1, the rear ends 31AR of the first cartridge holders 30A (i.e., the rear ends 31R of the first ink cartridges 31) are located below the front ends 31AF of the first cartridge holders 30A (i.e., the front ends 31F of the first ink cartridges 31). In the initial position F1, upper surfaces 30AY of the first cartridge holders 30A are located above lower surfaces 30AZ of the first cartridge holders 30A. When the first cartridge holders 30A are caused to pivot from the initial position F1 in the direction indicated by arrow X1 in FIG. 11 by the pivot angle θ1 (e.g., about 60°), the first cartridge holders 30A move to the first pivot position F2. In the first pivot position F2, the rear ends 31AR of the cartridge holders 30A (i.e., the rear ends 31R of the first ink cartridges 31) are located above the front ends 31AF of the first cartridge holders 30A (i.e., the front ends 31F of the first ink cartridges 31). Accordingly, ink particles that are a sedimentation component of sedimentation inks in rear portions of the ink packs 33 (hereinafter referred to as sedimentation particles when necessary) move to front portions of the ink packs 33. Then, when the first cartridge holders 30A are caused to pivot from the first pivot position F2 in the direction indicated by arrow X2 in FIG. 11 by the pivot angle θ1, the first cartridge holders 30A move to the initial position F1. Accordingly, the sedimentation particles in the front portions of the ink packs 33 move to the rear portions of the ink packs 33. The first controller repeatedly performs a pivot operation of moving the first cartridge holders 30A from the initial position F1 to the first pivot position F2 and then moving the first cartridge holders 30A from the first pivot position F2 to the initial position F1 for the pivot number of times $N_1$ determined by the pivot number determiner 67, for example. In addition, the first controller 71 rotates the first cartridge holders 30A at the pivot speed B1 determined by the speed determiner 68, for example.

Figure 12:
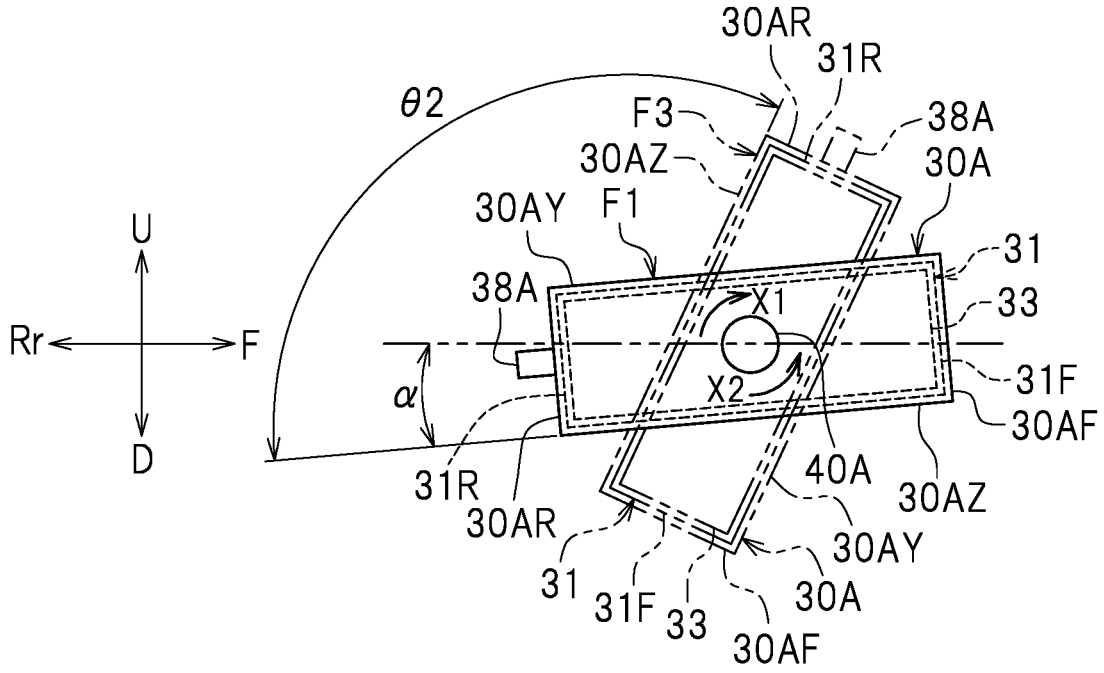
FIG. 12 is an explanatory view illustrating a state where the ink cartridges pivot by a pivot angle θ2 from the initial position.

FIG. 12 is an explanatory view illustrating a state where the first cartridge holders 30A (i.e., the first ink cartridges 31) pivot from the initial position F1 to a first pivot position F3. When the first cartridge holders 30A are caused to pivot from the initial position F1 in the direction indicated by arrow X1 in FIG. 12 by the pivot angle θ2 (e.g., about 120°), the first cartridge holders 30A move to the first pivot position F3. In the first pivot position F3, the rear ends 31AR of the cartridge holders 30A (i.e., the rear end 31R of the first ink cartridges 31) are located above the front ends 31AF of the first cartridge holders 30A (i.e., the front ends 31F of the first ink cartridges 31). In addition, the upper surfaces 30AY of the first cartridge holders 30A are located below the lower surfaces 30AZ of the first cartridge holders 30A. Accordingly, sedimentation particles in the rear portions of the ink packs 33 move to the front portions of the ink packs 33 and also move from the lower surfaces 30AZ to the upper surfaces 30AY. Then, when the first cartridge holders 30A are caused to pivot from the first pivot position F3 in the direction indicated by arrow X2 in FIG. 12 by the pivot angle θ2, the first cartridge holders 30A move to the initial position F1. Accordingly, the sedimentation particles in the front portions of the ink packs 33 move to the rear portions of the ink packs 33 and also move from the upper surfaces 30AY to the lower surfaces 30AZ. The first controller 71 repeatedly performs a pivot operation of moving the first cartridge holders 30A from the initial position F1 to the first pivot position F3 and then moving the first cartridge holders 30A from the first pivot position F3 to the initial position F1 for the pivot number of times $N_2$ determined by the pivot number determiner 67, for example. In addition, the first controller 71 causes the first cartridge holders 30A to pivot at the pivot speed B2 determined by the speed determiner 68, for example. Consequently, as compared to the pivot angle θ1, the pivot number $N_1$, and the pivot speed B1, sedimentation ink contained in the ink packs 33 is able to be more efficiently agitated.

Figure 13:
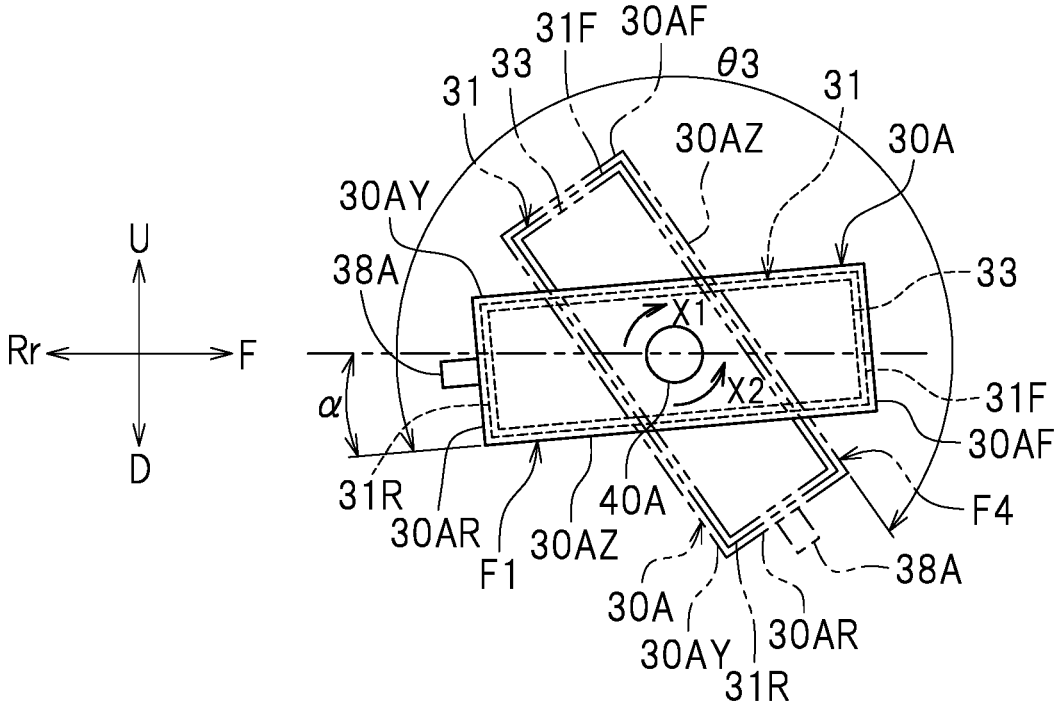
FIG. 13 is an explanatory view illustrating a state where the ink cartridges pivot by a pivot angle θ3 from the initial position.

FIG. 13 is an explanatory view illustrating a state where the first cartridge holders 30A (i.e., the first ink cartridges 31) pivot from the initial position F1 to a first pivot position F4. When the first cartridge holders 30A are caused to pivot from the initial position F1 in the direction indicated by arrow X1 in FIG. 13 by the pivot angle θ3 (e.g., about 240°), the first cartridge holders 30A move to the pivot position F4. Accordingly, sedimentation particles in the ink packs 33 move from the rear portions to the front portions and then from the front portions to the rear portions in the ink packs 33, and also move from the lower surfaces 30AZ to the upper surfaces 30AY. Then, when the first cartridge holders 30A are caused to pivot from the first pivot position F4 in the direction indicated by arrow X2 in FIG. 13 by the pivot angle θ3, the first cartridge holders 30A move to the initial position F1. Accordingly, sedimentation particles in the ink packs 33 move from the rear portions to the front portions and then from the front portions to the rear portions, and also move from the upper surfaces 30AY to the lower surfaces 30AZ. The first controller 71 repeatedly performs a pivot operation of moving the first cartridge holders 30A from the initial position F1 to the first pivot position F4 and then moving the first cartridge holders 30A from the first pivot position F4 to the initial position F1 for the pivot number of times $N_3$ determined by the pivot number determiner 67, for example. In addition, the first controller 71 causes the first cartridge holders 30A to pivot at the pivot speed B3 determined by the speed determiner 68, for example. Consequently, as compared to the pivot angle θ2, the pivot number $N_2$, and the pivot speed B2, sedimentation inks contained in the ink packs 33 is able to be more efficiently agitated.

In this preferred embodiment, as illustrated in FIG. 2, the plurality of first cartridge holders 30A provided in the first container 24 house the first ink cartridges 31W and 31M containing different sedimentation inks and the first ink cartridge 31G containing a non-sedimentation ink. The first cartridge holders 30A are subjected to a pivot operation for ink agitation based on the ink agitation degree SS of one of the plurality of first ink cartridges 31 (i.e., the plurality of first ink packs 33) housed in the first cartridge holders 30A. In this case, the ink agitation degree determiner 63 preferably determines the ink agitation degree SS of the first cartridge holder 30A based on the ink agitation degree SS of one of the sedimentation inks that is most likely to be deposited.

As described above, in the printer 10 according to this preferred embodiment, the ink agitation degree determiner 63 determines the ink agitation degree SS to the first ink cartridges 31. The angle determiner 66 determines a pivot angle θ from the initial position F1 of the first ink cartridges based on the determined ink agitation degree SS and the first data stored in the memory 62. Here, while the first ink packs 33 are in a stationary state, sedimentation of pigments and metal powder and other substances in sedimentation inks contained in the first ink packs 33 progresses. Depending on the degree of sedimentation and the remaining amount and properties of ink, sedimentation inks in the first ink packs 33 are favorably dispersed by agitating the inks in the first ink packs 33 to a small degree by a small pivot angle θ in some case, and the sedimentation inks in the first ink packs 33 are not favorably dispersed unless the ink in the first ink packs 33 are agitated greatly by a large angle in another case. In view of this, the first data stored in the memory 62 defines that a first pivot angle θ1 that is a pivot angle θ when the ink agitation degree SS is less than a first value $SS_1$ is smaller than a second pivot angle θ2 that is a pivot angle θ when the ink agitation degree SS is the first value $SS_1$ or more. The first controller 71 causes the first cartridge holders 30A (i.e., the first ink cartridges 31) to pivot by the relatively small first pivot angle θ1 when the ink agitation degree is less than first value $SS_1$, that is, sedimentation has not progressed relatively, and causes the first cartridge holders 30A (i.e., the first ink cartridges 31) to pivot by the relatively large second pivot angle 62 when the ink agitation degree is the first value $SS_1$ or more, that is, sedimentation has progressed relatively. In this manner, since the pivot angle θ of the first ink cartridges 31 is able to be changed in accordance with the degree of sedimentation of sedimentation ink and the remaining amount and properties of the ink, the time necessary for agitating the sedimentation ink is able to be reduced, as compared to a case where the first ink cartridges 31 are caused to pivot at a uniform pivot angle θ. In addition, the first controller 71 is configured or programmed such that when the first ink cartridges 31 pivot from the initial position F1 to the first pivot positions F2, F3, and F4, the front ends 31F of the first ink cartridges 31 are located below the rear ends 31R of the first ink cartridges 31, and when the first ink cartridges 31 pivot from the pivot positions F2, F3, and F4 to the initial position F1, the front ends 31F of the first ink cartridges 31 are located above the rear ends 31R of the first ink cartridges 31, and thus, sedimentation ink in the first ink packs 33 is able to be agitated favorably.

In the printer 10 according to this preferred embodiment, the pivot number determiner 67 determines the number of pivots (pivot number) N of the first cartridge holders 30A (i.e., the first ink cartridges 31) based on the ink agitation degree SS determined by the ink agitation degree determiner 63 and the second data. In this manner, the pivot number N is optimized in accordance with the degree of sedimentation of sedimentation ink and the remaining amount and properties of the ink so that sedimentation ink in the first ink packs 33 is able to be agitated favorably.

In the printer 10 according to this preferred embodiment, the first controller 71 repeatedly performs an operation of causing the first cartridge holders 30A (i.e., the first ink cartridges 31) to pivot a pivot number of times N determined by the pivot number determiner 67 at a predetermined time interval I. The predetermined time interval I is preferably a time interval smaller than a time interval Im in which sedimentation of completely agitated sedimentation ink progresses with a lapse of a stationary time so that the degree of ink sedimentation starts adversely affecting printing quality as degradation of printing quality during actual printing. For example, suppose Im is six hours, the time interval I is set at four fours. The state of ink agitation operation at this time is set by the first controller 71 with respect to the pivot angle, the pivot speed, the number of repetitive agitations, and so forth in order to sufficiently agitate ink in accordance with the remaining amount and properties of the ink. In this manner, ink agitation is periodically performed before ink sedimentation adversely affects printing quality as degradation of image quality during printing so that high printing quality can be always maintained during printing. In a case where it is already known that printing is not performed for a long time (e.g., one week or more) and the stationary time of ink is long, such periodic ink agitation may not be performed and agitation to a high agitation degree may be performed after a lapse of the long ink stationary time by setting the ink agitation degree SS high.

In the printer 10 according to this preferred embodiment, a periodic head maintenance operation of sucking ink from the nozzles 21 of the entirety or a portion of the ink heads 20 in each predetermined printing stop time in order to avoid clogging of the ink discharge ports at the front ends of the nozzles 21 of the ink heads 20 due to viscosity increase or drying of ink or to prevent degradation of printing quality due to a change in ink concentration near the nozzles 21. Before the periodic head maintenance operation is performed, the first controller 71 may perform an operation of causing the first cartridge holders 30A (i.e., the first ink cartridges 31) to pivot for a pivot number of times N determined by the pivot number determiner 67. Accordingly, this operation is able to avoid degradation of printing quality caused by insufficiently agitated sedimentation ink with an advanced degree of sedimentation that has been discharged from the first ink packs 33 while not being agitated in sucking the ink in the periodic head maintenance and is present from the supply ports 33B of the first ink packs 33 to the nozzles 21.

In the printer 10 according to this preferred embodiment, the speed determiner 68 determines the pivot speed B of the first cartridge holders 30A (i.e., the first ink cartridges 31) based on the ink agitation degree SS determined by the ink agitation degree determiner 63 and the third data stored in the memory 62. Here, if the first ink cartridges 31 pivot at low speed, sedimentation ink in the first ink packs 33 is slowly agitated in a long time, and as compared to a case where the pivot speed B is high, suppose the pivot angle θ is the same, the agitation amount of sedimentation ink applied to the first ink packs 33 (total workload obtained by multiplication of the pivot angle θ and the pivot speed B) is small. On the other hand, if the first ink cartridges 31 pivot at high speed, sedimentation ink in the first ink packs 33 is quickly agitated, and as compared to a case where the pivot speed B is low, suppose the pivot angle θ is the same, the amount of agitation of sedimentation ink applied to the first ink packs 33 is large. In view of this, the second data stored in the memory 62 defines that a second pivot speed B2 that is a pivot speed B when the ink agitation degree SS is the first value $SS_1$ or more is higher than a first pivot speed B1 that is a pivot speed B when the ink agitation degree SS is less than the first value $SS_1$. In this manner, since the pivot speed B of the first ink cartridges is able to be changed in accordance with the degree of sedimentation of sedimentation ink and the remaining amount and properties of the ink, the time necessary for agitating the sedimentation ink is able to be reduced, as compared to a case where the first ink cartridges 31 are caused to pivot at a uniform pivot speed B.

The printer 10 according to this preferred embodiment includes the first cartridge holders 30A housing the first ink cartridges 31, and the pivot mechanism 39 includes the first shafts 40A and 40B pivotably supporting the first cartridge holders 30A and the first driving mechanism 42 that causes the first cartridge holders 30A to pivot about the first shafts 40A and 40B. The first controller 71 controls the first driving mechanism 42. Accordingly, the first ink cartridges 31 is able to be caused to pivot efficiently so that sedimentation ink in the first ink packs 33 is able to be agitated.

In the printer 10 according to this preferred embodiment, the first pivot angle θ1 preferably is about 30° or more and less than about 90°, the second pivot angle θ2 preferably is about 90° or more and less than about 180°, and the third pivot angle θ3 preferably is about 180° or more and less than about 270°, for example. In this manner, since a plurality of pivot angles 6 of the first ink cartridge holders 31A (i.e., the first ink cartridges 31) can be provided in accordance with the degree of sedimentation of sedimentation ink and the remaining amount and properties of the sedimentation ink, the time necessary for agitating spot color ink is able to be reduced, as compared to a case where the first ink cartridges 31 are caused to pivot by a uniform pivot angle θ.

In the printer 10 according to this preferred embodiment, when the printer 10 is turned on, the first controller 71 causes the first cartridge holders 30A (i.e., the first ink cartridges 31) to pivot by the second pivot angle θ2 or the third pivot angle 63. Even in a case where the measurer 64 cannot measure a stationary time T of the first ink cartridges 31 while powder of the printer 10 is off, since the first ink cartridges 31 are caused to pivot by relatively large pivot angles 62 and 63 before printing, agitation of sedimentation ink in the ink packs 33 is able to be more reliably ensured.

Second Preferred Embodiment

Figure 14:
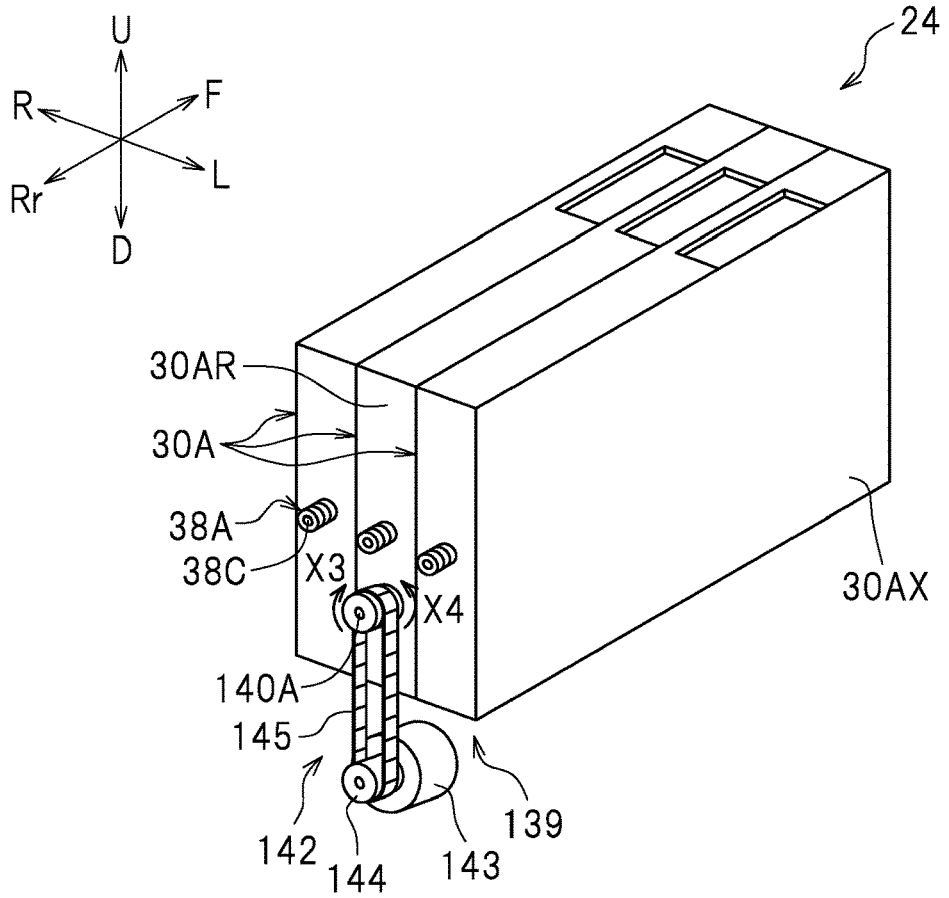
FIG. 14 is a perspective view of cartridge holders according to another preferred embodiment of the present invention.

As illustrated in FIG. 14, a first container 24 according to a second preferred embodiment includes a pivot mechanism 139. The pivot mechanism 139 causes first ink cartridges 31 (see FIG. 2) housing first ink packs 33 (see FIG. 2) charged with sedimentation inks to pivot. The pivot mechanism 139 includes a second shaft 140A pivotably supporting first cartridge holders 30A and a second driving mechanism 142 that causes the first cartridge holders 30A to pivot about the second shaft 140A. The second driving mechanism 142 includes a second motor 143, a second spindle 144 provided to the second motor 143, and an endless belt 145 wound around the second spindle 144 and the second shaft 140A. The second motor 143 is attached to a frame member 28 (see FIG. 2). The second motor 143 is connected to a controller 60 (see FIG. 2). The controller 60 controls operation and stopping of the second motor 143. The second shaft 140A is provided to a rear end 30AR of one of the plurality of first cartridge holders 30A located at the center of the plurality of first cartridge holders 30A. The second shaft 140A may be provided to the rear end 30AR of another first cartridge holder 30A. The second spindle 144 and the second shaft 140A extend in the direction in which the first ink cartridges 31 are inserted. In this preferred embodiment, the second spindle 144 and the second shaft 140A extend in the front-rear direction. The second shaft 140A is attached to a bearing provided on the frame member 28 and pivotably supporting the second shaft 140A. When the second motor 143 is driven to cause the belt 145 to travel, the first cartridge holders 30A pivot about the second shaft 140A left-right direction (indicated by arrow X3 and arrow X4 in FIG. 14).

Figure 15:
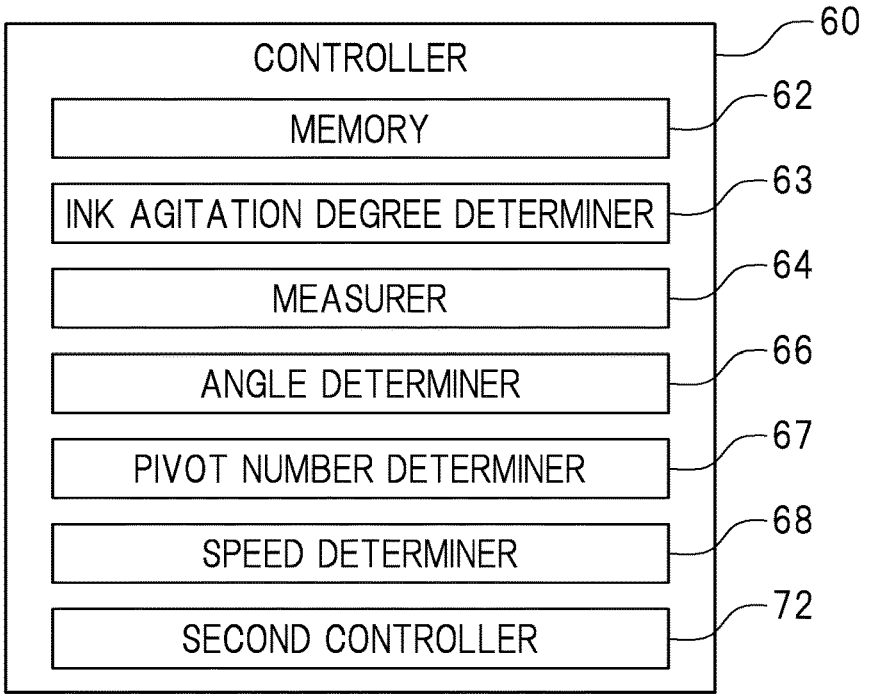
FIG. 15 is a block diagram of a controller according to another preferred embodiment of the present invention.

As illustrated in FIG. 15, the controller 60 is configured or programmed to include a memory 62, an ink agitation degree determiner 63, a measurer 64, an angle determiner 66, a pivot number determiner 67, a speed determiner 68, and a second controller 72.

The second controller 72 controls the second motor 143 of the second driving mechanism 142 to cause the first cartridge holders 30A to pivot and agitate sedimentation inks contained in the first ink packs 33. The second controller 72 may control the second motor 143 of the second driving mechanism 142 to perform the following operation. Specifically, in this operation, the first cartridge holders 30A (i.e., the first ink cartridges 31) are caused to pivot by a determined pivot angle θ in a third direction (indicated by arrow X3 in FIG. 14) so that the first cartridge holders 30A pivot from an initial position F1 to a first pivot position, and then the first cartridge holders 30A are caused to pivot in a fourth direction (indicated by arrow X4 in FIG. 14) opposite to the third direction so that the first cartridge holders 30A return from the first pivot position to the initial position F1. Here, when the first cartridge holders 30A (i.e., the first ink cartridges 31) pivot from the initial position F1 to the first pivot position, first ends (the left ends or the right ends in this preferred embodiment) of the first cartridge holders 30A are located below second ends (the left ends or the right ends in this preferred embodiment) of the first cartridge holders 30A, and when the first cartridge holders 30A pivot from the first pivot position to the initial position F1, the first ends of the first cartridge holders 30A are located above the second ends of the first cartridge holders 30A. When the printer 10 is turned on, the second controller 72 may cause the first cartridge holders 30A (i.e., the first ink cartridges 31) by a pivot angle θ2 or a pivot angle θ3.

Third Preferred Embodiment

Figure 16:
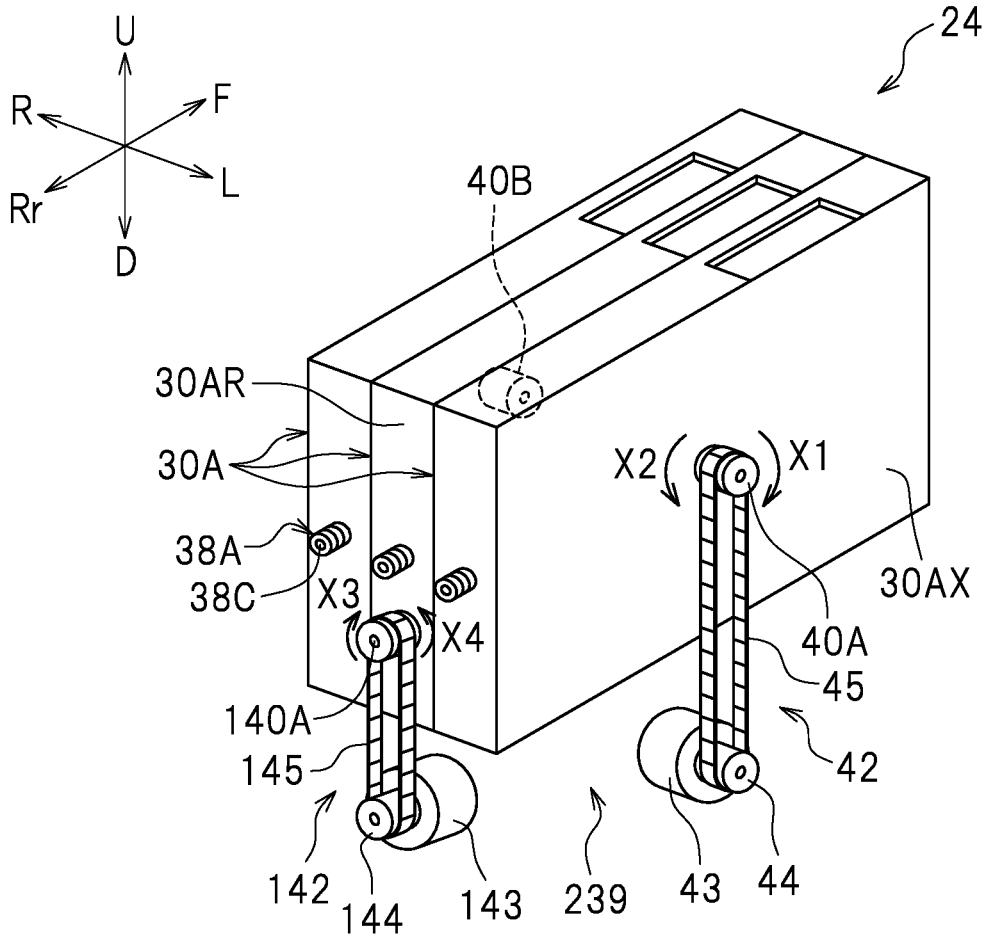
FIG. 16 is a perspective view of cartridge holders according to another preferred embodiment of the present invention.

As illustrated in FIG. 16, a first container 24 according to a third preferred embodiment includes a pivot mechanism 239. The pivot mechanism 239 causes first ink cartridges 31 (see FIG. 2) housing first ink packs 33 (see FIG. 2) charged with sedimentation inks to pivot. The pivot mechanism 239 includes first shafts 40A and 40B pivotably supporting the first cartridge holders 30A, a first driving mechanism 42 that causes first cartridge holders 30A to pivot about first shafts 40A and 40B, a second shaft 140A pivotably supporting the first cartridge holders 30A, and a second driving mechanism 142 that causes the first cartridge holders 30A to pivot about the second shaft 140A.

Figure 17:
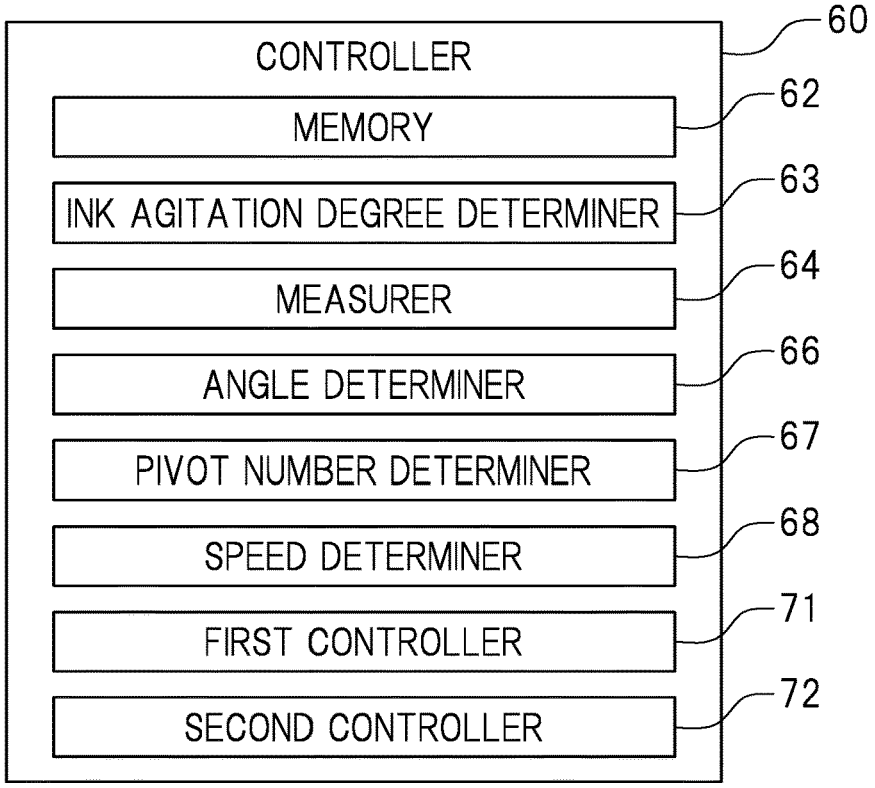
FIG. 17 is a block diagram of a controller according to another preferred embodiment of the present invention.

As illustrated in FIG. 17, the controller 60 is configured or programmed to include a memory 62, an ink agitation degree determiner 63, a measurer 64, an angle determiner 66, a pivot number determiner 67, a speed determiner 68, a first controller 71, and a second controller 72. The second controller according to the third preferred embodiment has the same configuration as that of the first controller 71 according to the second preferred embodiment, and thus, detailed description thereof will not be repeated.

Fourth Preferred Embodiment

Figure 18:
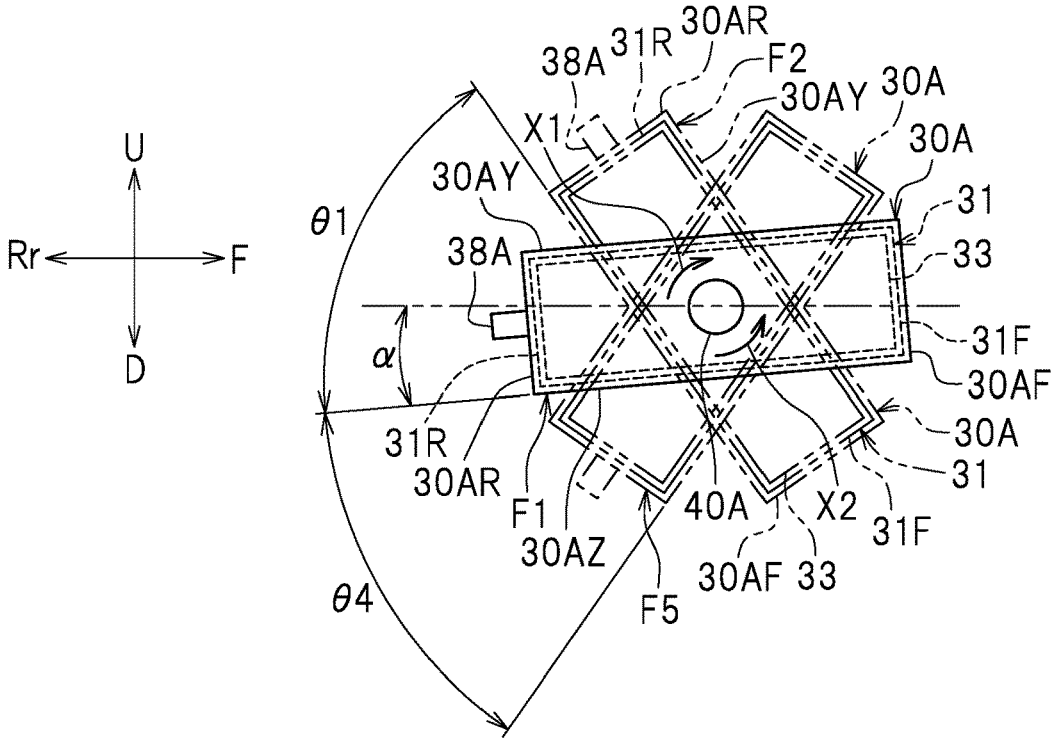
FIG. 18 is an explanatory view illustrating a state where ink cartridges pivot by a pivot angle θ4 from an initial position after the ink cartridges have pivoted by the pivot angle θ1 from the initial state.

As illustrated in FIG. 18, a first controller 71 controls a first motor 43 of a first driving mechanism 42 to perform a first operation of causing first cartridge holders 30A (i.e., first ink cartridges 31) to pivot by a determined pivot angle θ1 in a first direction (indicated by arrow X1 in FIG. 18) so that the first cartridge holders 30A pivot from an initial position F1 to a first pivot position F2, then perform a second operation of causing the first cartridge holders 30A to pivot by the pivot angle θ1 in a second direction (indicated by arrow X2 in FIG. 18) opposite to the first direction so that the first cartridge holders 30A return from the first pivot position F2 to the initial position F1, and after the second operation, perform a third operation of causing the first cartridge holders 30A to pivot by a pivot angle θ4 smaller than the determined pivot angle θ1 in the second direction so that the first cartridge holders 30A pivot from the initial position F1 to a second pivot position F5, and then perform a fourth operation of causing the first cartridge holders 30A to pivot in the first direction so that the first cartridge holders 30A return from the second pivot position F5 to the initial position F1. In this preferred embodiment, the pivot angle θ4 is smaller than the pivot angle θ1, but the pivot angle θ4 may be equal to the pivot angle θ1.

In the printer 10 according to this preferred embodiment, after the second operation is performed, the first controller 71 performs the third operation of causing the first cartridge holders 30A (i.e., the first ink cartridges 31) to pivot in the second direction (indicated by arrow X2 in FIG. 18) by the determined pivot angle θ4 so that the first cartridge holders 30A pivot from the initial position F1 to the second pivot position F5, and thereafter, performs the fourth operation of causing the first cartridge holders 30A to pivot in the first direction (indicated by arrow X1 in FIG. 18) so that the first cartridge holders 30A return from the second pivot position F5 to the initial position F1. Accordingly, as compared to a case where the first cartridges are caused to pivot in the first direction by the first operation and then pivot to the initial position F1 in the second direction by the second operation, addition of the third operation can obtain a larger pivot angle θ so that sedimentation ink in the first ink packs 33 is able to be agitated favorably.

In the foregoing preferred embodiments, the first ink cartridges 31 and the second ink cartridges 32 are oriented vertically in the first cartridge holders 30A and second cartridge holders 30B, respectively, but may be oriented horizontally. The expression "oriented horizontally" refers to a state in which a wide surface 31A having the largest area in each first ink cartridge 31 is oriented substantially in parallel with the horizontal plane, for example.

In the preferred embodiments described above, the first shafts 40A and 40B extend in the left-right direction and the second shaft 140A extend in the front-rear direction. The present invention, however, is not limited to this example. The first shafts 40A and 40B or the second shaft 140A may extend in the top-bottom direction.

In the preferred embodiments described above, the printer 10 includes the platen 14 on which the recording medium 5 is placed. The present invention, however, is not limited to this example. For example, in the printer 10, the platen 14 may be replaced by a table on which the recording medium 5 is placed and which is movable in at least the sub-scanning direction X.

In the preferred embodiments described above, the memory 62 stores the sedimentation data. Alternatively, the memory 62 may not store the sedimentation data as long as the memory 62 stores at least the first data.

In the preferred embodiments described above, the plurality of pivot speeds B are provided to the ink agitation degree SS of the first ink cartridges 31. Alternatively, the pivot speed B of the first ink cartridges 31 may be constant.

In the preferred embodiments described above, when the first cartridge holders 30A (i.e., the first ink cartridges 31) pivot from the initial position F1 to the first pivot position F2, the first ends of the first cartridge holders 30A are located below the second ends, and when first cartridge holders 30A pivot from the first pivot position F2 to the initial position F1, the first ends of the first cartridge holders 30A are located above second ends. The present invention, however, is not limited to this example. For example, in the initial position F1, in a case where the first ends of the first cartridge holders 30A are located at the same height as the second ends of the first cartridge holders 30A, when the first cartridge holders 30A pivot from the first pivot position F2 to the initial position F1, the first ends and the second ends of the first cartridge holders 30A may be located at the same height.

In the preferred embodiments described above, the ink cartridge 31G housing the first ink pack 33 charged with gloss ink is housed in the first cartridge holder 30A pivotably supported by the frame member 28. Alternatively, the first cartridge holder 30A housing the ink cartridge 31G may be non-pivotably supported by the frame member 28.

In the preferred embodiments described above, the first cartridge holders 30A are provided in the body 12 of the printer 10, but may be provided independently of the printer 10. In this case, the first cartridge holders 30A also communicate with the ink heads 20 through the ink paths 50. In addition, the first cartridge holders 30A may be controlled by another controller (not shown) different from and independent of the controller 60 of the printer 10. This another controller has a configuration similar to that of the first controller 61 of the controller 60. Such a configuration enables an agitation operation regularly and independently of the printer 10 so as to prevent ink sedimentation of sedimentation inks in the first ink cartridges 31 attached to the first cartridge holders 30A from progressing even when the power of the printer 10 is off for a long period, for example, one week.

In the preferred embodiments described above, sedimentation inks such as white ink and metallic ink and non-sedimentation inks such as process color inks and gloss ink are contained in the ink packs housed in the ink cartridges, but may be contained in ink bottles. In this case, the ink bottles may be directly attached to ink bottle holders so that sedimentation inks contained in the ink bottles are able to be agitated by causing the ink bottle holders to pivot.

In the preferred embodiments described above, the process color ink is a non-sedimentation ink, but if the process color ink is a pigment-based ink produced with an aqueous solvent, the process color ink can be a sedimentation ink in some cases. In such cases, the second ink cartridge 32 containing the process color ink is attached to the first cartridge holder 30A and an agitation operation is performed at the same time with agitation of white ink and metallic ink. Alternatively, the second cartridge holders 30B to which the second ink cartridges 32 containing process color inks may be configured to be capable of agitating the inks in a manner similar to the first cartridge holders 30A to which the first ink cartridges 31 containing white ink and metallic ink are attached. At this time, the first cartridge holders 30A and the second cartridge holders 30B are able to be set to perform optimum agitation operations individually in accordance with the remaining amount, properties, and the sedimentation degree of the sedimentation inks contained.

In the preferred embodiments described above, the first cartridge holders 30A are caused to pivot to agitate sedimentation ink in the first ink packs 33 housed in the first ink cartridges 31. However, the present invention is not limited to this example. For example, the first cartridge holders 30A may not be pivotable and the first ink cartridges 31 themselves may pivot.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink jet recording apparatus comprising:

an ink head including a nozzle that discharges a sedimentation ink onto a recording medium;

a pivot mechanism that pivots an ink cartridge housing an ink pack containing a sedimentation ink; and a controller that controls the pivot mechanism; wherein the controller is configured or programmed to include:

a measurer that measures a stationary time of the ink cartridge;

an ink agitation degree determiner that determines an ink agitation degree based on at least the stationary time, the ink agitation degree being a degree of ink agitation necessary for the ink cartridge;

a memory that stores first data defining a relationship between the ink agitation degree determined by the ink agitation degree determiner and a pivot angle of the ink cartridge from an initial position;

an angle determiner that determines the pivot angle based on the ink agitation degree determined by the ink agitation degree determiner and the first data; and a controller that controls the pivot mechanism to perform a first operation of causing the ink cartridge to pivot in a first direction by the determined pivot angle so that the ink cartridge pivots from the initial position to a first pivot position and then perform a second operation of causing the ink cartridge to pivot in a second direction opposite to the first direction so that the ink cartridge returns from the first pivot position to the initial position;

a first pivot angle that is the pivot angle when the ink agitation degree is less than a first value is smaller than a second pivot angle that is the pivot angle when the ink agitation degree is the first value or more; and when the ink cartridge pivots from the initial position to the first pivot position, a first end of the ink cartridge is located below a second end of the ink cartridge, and when the ink cartridge pivots from the first pivot position to the initial position, the first end of the ink cartridge is at a level identical to or above the second end.

2. The ink jet recording apparatus according to claim 1, wherein after the second operation, the controller performs a third operation of causing the ink cartridge to pivot in the second direction by the determined pivot angle or a pivot angle smaller than the pivot angle so that the ink cartridge pivots from the initial position to a second pivot position, and then performs a fourth operation of causing the ink cartridge to pivot in the first direction so that the ink cartridge returns from the second pivot position to the initial position.

3. The ink jet recording apparatus according to claim 1, wherein the memory stores second data that defines a relationship between the ink agitation degree and a number of pivots of the ink cartridge;

the controller includes a pivot number determiner that determines the number of pivots based on the ink agitation degree determined by the ink agitation degree determiner and the second data;

the controller causes the ink cartridge to pivot the number of pivots determined by the pivot number determiner; and a first pivot number that is the number of pivots when the ink agitation degree is less than the first value is smaller than a second pivot number that is the number of pivots when the ink agitation degree is the first value or more.

4. The ink jet recording apparatus according to claim 3, wherein the controller repeatedly performs an operation of causing the ink cartridge to pivot for the number of pivots determined by the pivot number determiner at a predetermined time interval.

5. The ink jet recording apparatus according to claim 3, wherein the controller performs a periodic head maintenance operation of sucking ink from the nozzle of the ink head in each predetermined printing stop time, and performs an operation of causing the ink jet cartridge to pivot for the number of pivots determined by the pivot number determiner before the periodic head maintenance is performed.

6. The ink jet recording apparatus according to claim 1, wherein the memory stores third data that defines a relationship between the ink agitation degree and a pivot speed of the ink cartridge;

the controller includes a speed determiner that determines the pivot speed based on the ink agitation degree determined by the ink agitation degree determiner and the third data;

the controller causes the ink cartridge to pivot at the pivot speed determined by the speed determiner; and a first pivot speed that is the pivot speed when the ink agitation degree is less than the first value is lower than a second pivot speed that is the pivot speed when the ink agitation degree is the first value or more.

7. The ink jet recording apparatus according to claim 1, further comprising a cartridge holder that houses the ink cartridge, wherein the pivot mechanism includes:

a shaft rotatably supporting the cartridge holder; and a driving mechanism that causes the cartridge holder to pivot about the shaft; and the controller controls the driving mechanism.

8. The ink jet recording apparatus according to claim 1, wherein the first pivot angle is about 30° or more and less than about 90°;

the second pivot angle is the pivot angle when the ink agitation degree is the first value or more and less than a second value and is about 90° or more and less than about 180°, the second value being larger than the first value; and a third pivot angle that is the pivot angle when the ink agitation degree is the second value or more is about 180° or more and less than about 270°.

9. The ink jet recording apparatus according to claim 8, wherein when the ink jet recording apparatus is turned on, the controller causes the ink cartridge to pivot by the second pivot angle or the third pivot angle.

* * * * *